US005972573A

United States Patent [19]

Miyazawa et al.

[11] Patent Number: 5,972,573

[45] Date of Patent: Oct. 26, 1999

[54] IMAGE FORMING METHOD

[75] Inventors: Kazuhiro Miyazawa; Shigeo Tanaka; Noriyuki Kokeguchi; Yoshihiko Suda; Junji Ito, all of Hino, Japan

[73] Assignee: Konica Corporation, Japan

[21] Appl. No.: 09/060,128

[22] Filed: Apr. 14, 1998

[30] Foreign Application Priority Data

| | | | |
|---|---|---|---|
| Apr. 15, 1997 | [JP] | Japan | 9-097279 |
| Aug. 21, 1997 | [JP] | Japan | 9-224867 |
| Aug. 29, 1997 | [JP] | Japan | 9-233686 |

[51] Int. Cl.[6] ..... G03C 7/407

[52] U.S. Cl. ..... 430/373; 430/414; 430/943

[58] Field of Search ..... 430/373, 414, 430/943

[56] References Cited

U.S. PATENT DOCUMENTS

| | | | |
|---|---|---|---|
| 3,723,117 | 3/1973 | Willems . | |
| 3,765,891 | 10/1973 | Travis | 430/373 |
| 3,902,905 | 9/1975 | Bissonette . | |
| 3,964,912 | 6/1976 | Price . | |
| 4,084,969 | 4/1978 | Nakamura et al. | 430/373 |
| 4,094,682 | 6/1978 | Fujiwhara et al. | 430/373 |
| 4,113,490 | 9/1978 | Fujiwhara et al. | 430/373 |
| 4,158,565 | 6/1979 | Maskasky . | |
| 4,192,681 | 3/1980 | Fujiwhara et al. | 430/373 |
| 4,880,725 | 11/1989 | Hirai et al. | 430/373 |
| 5,707,788 | 1/1998 | Nishio | 430/440 |
| 5,721,094 | 2/1998 | Komatsu et al. | 430/440 |

FOREIGN PATENT DOCUMENTS

| | | |
|---|---|---|
| 0436947 | 7/1991 | European Pat. Off. . |
| 0653678 | 5/1995 | European Pat. Off. . |
| 0730198 | 4/1996 | European Pat. Off. . |

*Primary Examiner*—Hoa Van Le

*Attorney, Agent, or Firm*—Jordan B. Bierman; Bierman, Muserlian and Lucas

[57] ABSTRACT

An image forming method of a silver halide light sensitive photographic material including a color image forming layer containing a silver halide emulsion and a dye providing material is disclosed, the image forming method comprising the steps of developing the exposed photographic material with a first processing solution and subjecting the developed photographic material to amplification with a second processing solution, wherein the first processing solution contains a black-and-white developing agent and a color developing agent.

18 Claims, No Drawings

IMAGE FORMING METHOD

FIELD OF THE INVENTION

The present invention is related to an image forming method which is capable of providing image with high maximum density even when subjected to rapid access amplification development, and is improved in process stability.

BACKGROUND OF THE INVENTION

Silver halide light sensitive photographic materials (hereinafter, referred to as photographic materials), which have enhanced properties such as high sensitivity and excellent tone reproduction as compared to other print materials, are widely employed. An image forming method has been known, employing amplification development of a silver halide photographic material, in which advantageous effects of the silver halide photographic material are displayed, in which consumption of silver halide can be reduced, and which is preferable in terms of effective use of natural resources. As an example of the amplification development is cited a method in which an oxidized color developing agent is formed by using an oxidizing agent such as hydrogen peroxide or a cobalt (III) complex in the presence of developed silver as a catalyst and subsequently, a dye image is formed upon reaction with a coupler. Of these, the amplification development by the use of hydrogen peroxide as an oxidizing agent is preferred in terms of high amplification efficiency and reduced environmental load.

Amplification development is comprised of a silver developing process which forms catalytically active silver nuclei and an amplification process of amplification development catalyzed by the silver nuclei. WO 93/11460 and JP-A 7-159960 and 7-175190 (the term, JP-A refers to an unexamined and published Japanese Patent Application) disclose an image forming method by the use of an amplification developing solution concurrently containing a developing agent and an oxidizing agent (alternatively, denoted as a single solution type amplification development). Since the silver development and amplification processes simultaneously proceed in the single solution amplification development, there occur problems such that an optimum condition for each process can not be simultaneously achieved, making it difficult to obtain images with satisfied photographic performance, and the developing solution concurrently which contains an oxidizing agent and a reducing agent which deteriorates more quickly and is inferior in aging stability. Further, WO 92/07299 and 93/01524, JP-A 61-8, 61-80150, 61-88259, 6-313954, 7-77788, 9-106052 and 9-127664 disclose image forming methods, in which to separate the amplification process from the silver development process, plural processing solutions are employed, the silver development is performed in the first processing solution, and the amplification is performed in the second processing solution (hereinafter, denoted as dual solution type amplification development).

In the image forming method by employing conventional color development which is the prevalent trend of development in the market, the use of high chloride containing silver halide emulsion results in shortened processing time, however, further rapid access is still desired. Through improvements of equipments such as automatic processors and printers, photographic processing solutions and photographic materials, so-called mini-labs have widely spread. Such mini-labs can be installed in a small area and are easily operated. There is still desired, however, a mini-lab with a low price and capable of forming stable and high quality images.

In the dual solution type amplification development described in JP-A 61-80149, 61-80150, 61-88259, 6-313954 and 7-77788; WO 92/07299 and 93/01524, it is difficult to simultaneously achieve both shortening of the amplification developing time and sufficient density, and therefore further improvement in these area is still desired. Further, in the dual solution type amplification development described in JP-A 9-106052 and 9-127664, it was proved that when being continuously processed, the density in the midscale density portion tended to fluctuate and its improvement is still sought.

SUMMARY OF THE INVENTION

An object of the present invention is to provide an image forming method which is capable of forming images with high maximum density even when subjected to rapid access amplification development and is improved in process stability.

The above objective can be accomplished by the following constitution:

(1) an image forming method of a silver halide light sensitive photographic material comprising a support having thereon photographic component layers including a color image forming layer containing a silver halide emulsion and a dye providing material, the image forming method comprising the steps of:
  (i) developing an exposed photographic material with a first processing solution and
  (ii) subjecting the developed photographic material to amplification with a second processing solution, wherein the first processing solution contains a black-and-white developing agent and a color developing agent;

(2) the image forming method as described in (1), wherein the second processing solution contains an oxidizing agent;

(3) the image forming method as described in (1), wherein the silver halide emulsion contains silver halide grains having a chloride content of 80 mol % or more;

(4) the image forming method as described in (1), wherein the black-and-white developing agent is a compound represented by the following formula (A):

formula (A)

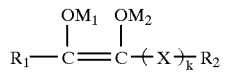

wherein $R_1$ and $R_2$ independently represent an alkyl group, an amino group or an alkylthio group, provided that $R_1$ and $R_2$ may be combined with each other to form a ring; k is an integer of 0 or 1; when k is 1, X represents —CO— or —CS—; and $M_1$ and $M_2$ independently represent a hydrogen atom or an alkaline metal atom;

(5) the image forming method as described in (4), wherein the pH of the first processing solution ($P_1$) is not less than 6.0 and less than 10.0;

(6) the image forming method as described in (2), wherein difference between the pH of the first processing solution ($P_1$) and that of the second processing solution ($P_2$) is 1.0 or more;

(7) the image forming method as described in (6), wherein when the first processing solution is mixed with an equal volume of the second processing solution, the pH of the mixture is closer to $P_2$ than to $P_1$;

(8) the image forming method as described in (1), wherein the first processing solution or the second processing solution contains an aqueous soluble surfactant;

(9) the image forming method as described in (1), wherein the first processing solution or the second processing solution contains a compound represented by the following formula (B):

formula (B)

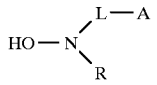

wherein L represents an alkylene group; A represents a carboxy group, sulfo group, phosphono group, phosphine group, hydroxy group, amino group which may be substituted by an alkyl group, ammonio group which may be substituted by an alkyl group, carbamoyl group which may be substituted by an alkyl group, and sulfamoyl group which may be substituted by an alkyl group; and R represents a hydrogen atom or an alkyl group;

(10) the image forming method as described in (1), wherein the step (i) or (ii) is performed in the presence of an aqueous soluble coupler capable of reacting with an oxidation product of a color developing agent;

(11) the image forming method as described in (6), wherein difference between the temperature of the first processing solution ($T_1$ ° C.) and that of the second processing solution ($T_2$ ° C.) satisfy the following requirement:

$$T_1-T_2<10;$$

(12) the image forming method as described in (4), wherein a molar ratio of the black-and-white developing agent to the color developing agent is 0.02 to 2.0;

(13) the image forming method as described in (4), wherein the black-and-white developing agent is a compound represented by the following formula (A-a):

formula (A-a)

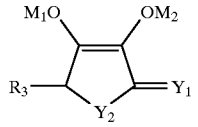

wherein $R_3$ represents a hydrogen atom, an alkyl group, aryl group, amino group, alkoxy group, sulfo group, carboxy group, carbonamido group, sulfonamido group; $Y_1$ represents O or S; $Y_2$ is O, S or $NR_4$, in which $R_4$ represents an alkyl group or an aryl group; and $M_1$ and $M_2$ are each the same as defined in the formula (A) above described;

(14) the image forming method as described in (5), wherein the pH of the first processing solution is not less than 7.0 and less than 9.5; and

(15) the image forming method as described in (8), wherein the aqueous soluble surfactant is represented by formulas (I) to (XI), as described later.

DETAILED DESCRIPTION OF THE INVENTION

The present invention relates to an image forming method, in which after a photographic material is exposed to light, at least two photographic processing solutions are successively supplied to the exposed photographic material, causing development, followed by amplification. Herein, silver development is performed in the processing solution which is at first supplied to the photographic material (simply, denoted as the first processing solution), and amplification is mainly performed in the processing solution which is secondly supplied to the photographic material (denoted as the second processing solution).

The first processing solution contains a developing agent to perform silver development, and containing no oxidizing agent to perform amplification; and the second processing solution contains the oxidizing agent. Herein, the silver development is referred to as development to form a silver image.

A color developing agent is contained in either or both the first and the second processing solutions.

In the invention, the amplification development or amplified developing treatment is defined as a process in which latent images formed by exposing a photographic material to light, ares developed with a color or a black-and-white developing agent to form developed silver images, and dye images can be formed or amplified employing chemical reaction catalyzed by the developed silver. Concretely, for example, an oxidized developing agent produced by developed silver-catalyzed redox reaction between the developing agent and an oxidizing agent, reacts with a coupler through coupling reaction to form a dye image.

One feature of the invention is that the first processing solution contains a black-and-white developing anent and a color developing agent, and thereby, the desired high maximum density is obtained even after a short amplification developing time, and further the process stability is enhanced. Although the mechanism of the process stability being enhanced is not clarified, it is presumed that the black-and-white developing agent contained in the first processing solution undergoes mainly silver development to enhance the silver developing speed, enabling completion of silver development in the first processing solution so that most of the color developing agent contained in the first processing solution is not consumed but diffuses promptly and uniformly into the lower layer.

Black-and-white developing agents usable in the first processing solution include dihydroxybenzenes, 3-pyrazolidones, pyrogallols, glycines, hydroxyamines, hydrazines, aminophenols, reductones, and 3-aminopyrazolines. Of these, a black-and-white developing agent represented by the following formula (A) is preferably employed in terms of shortening of the developing time and a high efficiency in the amplification in the second processing solution:

Formula (A)

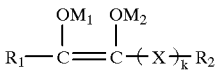

wherein $R_1$ and $R_2$ independently represent a substituted or unsubstituted alkyl group, a substituted or unsubstituted amino group or a substituted or unsubstituted alkylthio group, provided that $R_1$ and $R_2$ may combined with each other to form a ring; k is an integer of 0 or 1; and when k is 1, X represents —CO— or —CS—; and $M_1$ and $M_2$ independently represent a hydrogen atom or alkaline metal atom.

Furthermore, a black-and-white developing agent selected from compounds represented the following formula (A-a), which is formed by the combination of $R_1$ and $R_2$ of formula (A):

Formula (A-a)

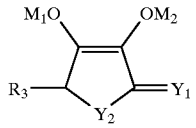

wherein $R_3$ represents a hydrogen atom, a substituted or unsubstituted alkyl group, a substituted or unsubstituted aryl group, a substituted or unsubstituted amino group, a substituted or unsubstituted alkoxy group, a sulfo group, a carboxy group, an amido group or sulfoamido group; $Y_1$ represents O or S; $Y_2$ represents O, S or $NR_4$, in which $R_4$ represents a substituted or unsubstituted alkyl group or a substituted or unsubstituted aryl group; $M_1$ and $M_2$ each are the same as defined in the formula (A).

The alkyl group in the formula (A) or (A-a) is preferably a lower alkyl group having 1 to 5 carbon atoms, the amino group is preferably unsubstituted one or one substituted by a lower alkyl group, the alkoxy group is preferably a lower one, and the aryl group is preferably a phenyl group or naphthyl group, which may be substituted. Examples of a substituent include hydroxy group, an alkoxy group, sulfo group, carboxy group, carbonic amido group. sulfonic amido group and a halogen atom.

Exemplary examples of the black-and-white developing agent represented by formula (A) or (A-a) are shown below, but the invention is not limited to these examples.

| Compound No. | X | $R_1$ | $R_2$ | $M_1$ | $M_2$ |
|---|---|---|---|---|---|
| A-1 | — (k = 0) | $HOCH_2$—CH(OH)—CH(OH)— | —OH | H | H |
| A-2 | — (k = 0) | $CH_3$—CH(OH)—CH(OH)— | —OH | H | H |
| A-3 | — (k = 0) | $HOCH_2$—CH(OH)—CH(OH)— | —$CH_3$ | H | H |
| A-4 | — (k = 0) | $CH_3$—CH(OH)—CH(OH)— | —$CH_3$ | H | H |
| A-5 | —C(=O)— (k= 1) | $HOCH_2$—CH(OH)—CH(OH)— | —OH | H | H |
| A-6 | —C(=O)— (k= 1) | $CH_3$—CH(OH)—CH(OH)— | —OH | H | H |
| A-7 | —C(=S)— (k = 1) | $HOCH_2$—CH(OH)—CH(OH)— | —OH | H | H |
| A-8 | —C(=S)— (k = 1) | $CH_3$—CH(OH)—CH(OH)— | —OH | H | H |
| A-9 | —C(=O)— (k= 1) | $HOCH_2$— | —OH | Na | H |
| A-10 | —C(=O)— (k= 1) | $HOCH_2$— | —$CH_3$ | H | H |
| A-11 | —C(=O)— (k= 1) | $HOCH_2$— | —$C_2H_5$ | H | H |
| A-12 | —C(=O)— (k= 1) | $HOCH_2$— | —$(CH_2)_2OH$ | H | Na |
| A-13 | O | O | H | H | H |
| A-14 | O | O | $CH_3$— | H | H |

-continued

| Compound No. | X | $R_1$ | $R_2$ | $M_1$ | $M_2$ |
|---|---|---|---|---|---|
| A-15 | O | O | $CH_2$—<br>\|<br>OH | H | H |
| A-16 | O | O | $CH_3$—CH—<br>\|<br>OH | H | H |
| A-17 | O | O | $HOCH_2$—CH—<br>\|<br>OH | H | H |
| A-18 | O | O | $ClCH_2$—CH—<br>\|<br>OH | Na | H |
| A-19 | O | O | $HOOCCH_2$—CH—<br>\|<br>OH | H | Na |
| A-20 | S | O | H | Na | H |
| A-21 | S | O | $CH_3$—CH—<br>\|<br>OH | H | H |
| A-22 | S | O | $HOCH_2$—CH—<br>\|<br>OH | H | H |
| A-23 | O | $NCH_3$ | H | H | H |
| A-24 | O | NH | $HOCH_2$—CH—<br>\|<br>OH | H | K |
| A-25 | O | S | H | H | H |
| A-26 | O | S | $HOCH_2$—CH—<br>\|<br>OH | H | H |
| A-27 | O | S | $CH_3$—CH—<br>\|<br>OH | H | H |
| A-28 | S | S | H | H | H |
| A-29 | S | S | $HOCH_2$—CH—<br>\|<br>OH | H | H |
| A-30 | S | S | H | H | H |

These compounds are almost ascorbic acid, erythorbic acid or derivatives thereof, which are commercially available or can be readily synthesized according to the known method.

The color developing agent used in the first processing solution is preferably an aromatic primary amine color developing agent, including N,N-diethyl--p-phenylenediamine, 2-amino-5-diethylaminotoluene, 2-amino-5-(N-ethyl-N-lauryl)aminotoluene, 4-(N-ethyl-N-β-hydroxyethyl)aminoaniline, 2-methyl-4-(N-ethyl-N-β-hydroxyethyl)aminoaniline, 4-amino-3-methyl-N-ethyl-N-(β-methanesulfonamido)ethylaniline, 4-amino-3-β-methaneamido-ethyl-N,N-diethylaniline, N,N-dimethyl-p-phenylenediamine, 4-amino-3-methl-N-ethyl-N-methoxyethylaniline, 4-amino-3-methyl-N-ethyl-N-β-ethoxyethylaniline, and 4-amino-3-methyl-N-ethyl-N-γ-hydroxyethylpropylaniline. Besides the aromatic primary amine color developing agents, there are also usable a sulfonylhydrazide or carbonylhydrazide type color developing agent described in European Patent 565,165, 572,054 and 593,110; JP-A 8-202002, 8-227131 and 8-234390.

The ratio of a black-and-white developing agent to a color developing agent contained in the first processing solution is optional, and the molar ratio is preferably 0.02 to 2.0 and more preferably 0.1 to 1.0.

The first processing solution, in addition to the color and black-and-white developing agents, may further contain a compound known in a photographic processing solution, such as a pH buffering agent, a restrainer, preservative or a metal ion sequestering agent.

Examples of the pH buffering agent include sodium or potassium carbonate, sodium or potassium hydrogen carbonate, sodium or potassium borate, sodium or potassium phosphate, disodium or dipotassium hydrogen phosphate, sodium or potassium dihydrogen phosphate, calcium hydroxide, sodium silicate, β-alanine diacetic acid, arginine, asparagine, ethylenediamine, ethylenediaminetetraacetic acid, ethylenediaminedisuccinic acid, glycine, histidine, imidazole, isoleucine, leucine, purine, and pyrolidine. Examples of the restraining agent include halide ions such as chloride ion, bromide ion and iodide ion; and known restraining agents such as benzotriazole, 5-nitrobenzotriazole, 5-methylbenzotriazole, adenine and 1-phenyl-5-mercaptotetrazole. Examples of the preservative include sodium sulfite, potassium sulfite, hydroxylamine and diethylhydroxylamine. Examples of the metal ion sequestering agent include aminopolycarboxylic acid and its salt, such as ethylenediaminetetraacetic acid, 1,2-propylenediaminetetraacetic acid, nitrilotriacetic acid, diethylenetriaminepentaacetic acid, iminodiacetic acid, trimethylenetetraaminehexaacetic acid, ethylenediaminetetrapropionic acid, trans-cyclohexane-1,2-diaminetetraacetic acid and ethylenediamine-N,N'-diacetic-N,N'-dipropionic acid; 1-hydroxy-ethylidene-1,1-diphosphonic acid its salt; catechol disulfonic acid and its salt and pyridine-2-carboxylic acid its salt. Specifically in cases where a metal ion sequestering agent having a stability constant with $Fe^{2+}$ or $Ag^{+}$ of 5.0 or more is employed, effects of the invention are stably displayed against the variation of the processing temperature or the timing of supplying the processing solution.

Examples of the oxidizing agent contained in the second processing solution include hydrogen peroxide and its salt or adduct which is capable of providing hydrogen peroxide, a peroxo compound such as peroxoborate or peroxocarbonate, cobalt (III) complex such as cobalt hexaamine complex, halous acids such as chlorous acid, and periodic acid. Of these, the use of hydrogen peroxide, or its salt or adduct which is capable of providing hydrogen peroxide is advantageously employed in terms of being high in the amplification effect and reduced in the environmental load.

The second processing solution, in addition to the oxidizing agents, may further contain a compound known in a photographic processing solution, such as a pH buffering agent, a restrainer, preservative or a metal ion sequestering agent, as described above.

Although the black-and-white and color develop ing agents may be contained in the second processing solution without adversely affecting the storage stability thereof, an embodiment in which the black-and-white and color developing agents are not substantially contained is preferred. The embodiment of not being substantially contained means one in which the black-and-white and color developing agents are not contained at the initial stage of preparing the second processing solution. In this instance, the case where the black-and-white and color developing agents are carried-in at the continuous processing, is excluded.

In the invention, the pH of the first processing solution is preferably at least 0.5 lower than that of the second processing solution. Thereby a high maximum density can be obtained even for a short period of the amplification developing time and the process stability is enhanced. Although the mechanism of enhancement of the process stability is not clarified, it is due to the swollen thickness of a photographic material being varied with the pH of the photographic processing solution, and the higher the pH, the greater the swollen thickness. Thus, it is contemplated that the pH of the first solution is set lower and when the second processing solution with a higher pH is supplied to the photographic material, the swollen thickness is slightly increased, aiding an incorporation of ingredients of the second processing solution into the photographic material.

The pH of the first processing solution may be set within a range capable of promptly causing silver halide development and it is not specifically limited. The pH is preferably not less than 6.0 in terms of being capable of completing the silver halide development in a short time, and is preferably less than 10.0 in terms of optimally inhibiting the swollen thickness. The pH is more preferably not less than 7.0 and less than 9.5.

The pH of the second processing solution is not limited as long as it is set within the range of satisfying the conditions of the invention. Thus, the pH is preferably not less than 9.0 and more preferably not less than 10.0, and it is also preferably less than 12.5 in terms of optimally restraining an increase of the fog density.

Cited as a developing agent used in the first processing solution are a black-and-white developing agent and a color developing agent, each of which may be used singly or in combination. The first processing solution contains preferably at least o ne black-and-white developing agent in terms of permitting completion of silver halide development in a short time, and more preferably contains one selected from the compounds represented by formula (A) mentioned previously.

According to the invention, the temperature of the first processing solution ($T_1$ ° C.) and the temperature of the second processing solution ($T_2$ ° C.) preferably satisfy the following condition, $T_1-T_2<10$; and thereby, the high maximum density can be obtained even for a short period of the amplification developing time and the process stability is enhanced. Although the mechanism of the enhancement of process stability is not clarified, it is contemplated that setting the temperature difference between the first and second processing solutions within an optimum range reduces nonuniformity of ingredients in a mixture of the first and second processing solutions, due to the processing temperature difference. Further, when the temperature of the first processing solution is lower than that of the second processing solution, the latitude of the temperature difference is broadened. Although the mechanism thereof is not definitely clarified, it is believed to be due to the swelling speed of a photographic material varying with the temperature of the photographic processing solution, and the higher the temperature, the greater the swollen thickness. Thus, it is contemplated that the temperature of the first solution is set lower and when the second processing solution with a higher temperature is supplied to the photographic material, the swollen thickness is slightly increased, aiding in incorporation of ingredients of the second processing solution into the photographic material and avoiding nonuniformity of ingredients in the mixture.

As long as the requirements of the invention are met, the temperature of the first or second processing solution is optional, and when the temperature of the second processing solution is not lower than 35° C., and higher than that of the first processing solution, effects of the invention such as improved process stability are preferably exhibited.

In the invention, difference between the pH of the first processing solution ($P_1$) and that of the second processing solution ($P_2$) is preferably not less than 1.0, and when the first processing solution is mixed with an equal volume of the second processing solution, the pH of the mixture is preferably closer to that of the second solution ($P_2$) than to that of the first solution ($P_1$), thereby leading to improved process stability. Although the mechanism is not definitely clarified, it is contemplated that when the difference in pH between the first and second processing solutions is large, the pH during the amplification becomes constant at an earlier stage. Thus, the first processing solution contained in the photographic material is mixed with the second processing solution at the time of the amplification and is substantially substituted by the second processing solution, and therefore it is contemplated that when the pH of the mixture of the first and second processing solutions is closer to $P_2$, the pH becomes stable at the earlier stage of the amplification, leading to improved process stability.

The pH of the first or second processing solution is optional, as long as it falls within the range of satisfying the conditions of the invention, and when the pH of an equal volume mixture of the first and second processing solutions falls within the range of $P_2 \pm 0.5$, the effects of the invention are preferably displayed.

When the pH of the first and second processing solution ($P_1$, $P_2$) satisfies the requirements described above, the temperature of the first or second processing solution is optional and preferably satisfies the requirement described above, such that $T_1 - T_2 < 10$.

There can be employed various types of the method in image formation according to the invention, including: a method in which the photographic material is transported through processing baths filled with processing solutions described above; a method in which a processing solution supplied to a slit-formed processing bath and a photographic material is transported there through; a spraying method in which the processing solution is supplied in a spray form, a web processing method by bringing the photographic material into contact with a carrier impregnated with a processing solution; and a method by coating a viscous processing solution.

When supplying the second processing solution to the photographic material, to restrain lowering of the efficiency of amplification due to leaching-out of the first processing solution, from the photographic material, an embodiment in which the second processing solution is directly supplied to the photographic material in a spraying method or a coating method, without the use of a processing bath, and an embodiment in which the second processing solution is supplied into a filled tank having an inside thickness of not more than 100 times that of the thickness of the photographic material. Particularly preferred is the embodiment in which the second processing solution is directly sprayed onto the photographic material, without the use of a processing bath.

The oxidizing agent used for amplification is contained preferably in an amount of 0.005 to 3.0 mol/l and more preferably 0.02 to 1.5 mol/l.

The color developing agent is contained in the first processing solution preferably in an amount of not more than 50.0 mmol/l in terms of minimal precipitation thereof. In cases where the color developing agent is not contained in the second processing solution, its content in the first processing solution is preferably not less than 5.0 mmol/l.

The processing time in the first or second processing solution depends on the kind of a photographic material, the processing temperature, the activity of the processing solution, etc., and the processing time in the first processing solution is preferably not more than 20 sec. and more preferably not more than 15 sec. The processing time in the first and second processing solutions is preferably not more than 45 sec. and more preferably not more than 30 sec.

In the invention, an aqueous soluble surfactant is preferably contained either in the first processing solution or the second processing solution, thereby leading to an improvement in graininess. Although the mechanism has not been clarified, it is contemplated that the presence of the surfactant enhances uniformity in diffusion of the color developing agent or oxidizing agent in the photographic material, reducing localized color dye formation.

The aqueous soluble surfactant according to the invention refers to a compound having, within the molecule, two groups such as a hydrophilic group and a hydrophobic group which are opposite in solubility to the solvent, so-called amphi-solvolytic substance. The aqueous soluble surfactant is soluble in water and classified into an ionic surfactant and a nonionic surfactant, depending on whether it is ionic or not, and the ionic surfactant is further classified into an anionic surfactant and a cationic surfactant, according to ionic species. The surfactant can be employed singly or in combination.

The surfactant preferably employed in the invention is a compound represented by the following formulas (I) through (XI).

Formula (I)

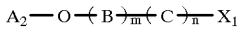

In the Formula, $A_2$ represents a univalent organic group such as an alkyl group having 6 to 50 (preferably, 6 to 35) carbon atoms (e.g. hexyl, heptyl, octyl, nonyl, decyl, undecyl and dodecy) and an aryl group substituted by an alkyl group having 1 to 35 carbon atoms or an alkenyl group having 2 to 35 carbon atoms. Preferred substituent to the aryl group include an alkyl group having 1 to 18 carbon atoms (e.g. unsubstituted alkyl groups such as methyl, propyl, butyl, pentyl, hexyl, heptyl, octyl, nonyl, decyl, undecyl and dodecyl), a substituted alkyl group such as benzyl and phenethyl, and an alkenyl having 2 to 20 carbon atoms (e.g. unsubstituted alkenyl group such as oleyl, cetyl and allyl, and substituted alkenyl group such as styryl). The aryl group includes phenyl, biphenyl and naphthyl, and preferably phenyl. The aryl group may be substituted at any position of ortho, meta and para.

B and C independently represents ethyleneoxy (i.e. $CH_2CH_2O$), propyleneoxy [i.e. $CH(CH_3)CH_2O$], or

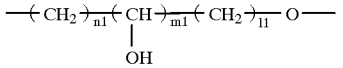

in which $n_1$, $m_1$ and $l_1$, each represent an integer of 0, 1, 2 or 3, provided that $n_1$, $m_1$ and $l_1$, all are not 0 at the same time; m and n represent an integer of 0 to 100, provided that m and n are not 0 at the same time. $X_1$ represents a hydrogen atom, an alkyl group or an aryl group, and examples thereof are the same as cited in $A_2$.

Formula (II)

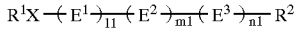

In the Formula, $R^1$ represents a hydrogen atom, an aliphatic hydrocarbon group or an acyl group; $R^2$ represents a hydrogen atom or an aliphatic hydrocarbon group; $E_1$ is ethyleneoxy, $E_2$ is propyleneoxy and $E_3$ is ethyleneoxy; X represents carboxy, —O— or

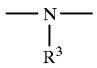

in which $R^3$ represents a hydrogen atom, an aliphatic hydrocarbon group or

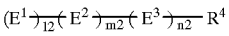

in which $R^4$ represents a hydrogen atom or an aliphatic hydrocarbon group; $l_1$, $m_1$ and $n_1$, or $l_2$, $m_2$ and $n_2$ each represent an integer of 0 to 100, provided that $l_1$, $m_1$ and $n_1$, or $l_2$, $m_2$ and $n_2$ are not 0 at the same time.

Formula (III)

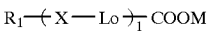

In the Formula, $R^1$ represents an aliphatic hydrocarbon group (e.g. saturated or unsaturated, substituted or unsubstituted, straight-chained or branched alkyl group); X represents

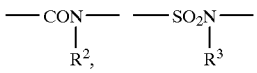

in which $R^2$ and $R^3$ are each a hydrogen atom or the same as defined in $R^1$; l represents an integer of 0 or 1; M represents a hydrogen atom, an alkaline metal (e.g. Na, K), ammonium ion, or an organic ammonium ion; and $L_0$ represents an alkylene group.

Formula (IV)

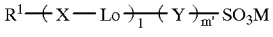

In the Formula, $R^1$ represents an aliphatic hydrocarbon group (e.g. saturated or unsaturated, substituted or unsubstituted, straight-chained or branched alkyl group); X represents

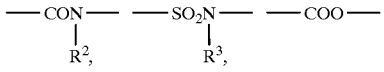

in which $R^2$ and $R^3$ are each a hydrogen atom or the same as defined in $R^1$; l and m' each represent an integer of 0 or 1; $L_0$ represents an alkylene group; Y represents an oxygen atom; M represents an alkaline metal (e.g. Li, Na, K).

Formula (V)

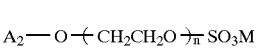

In the Formula, M represents an alkaline metal (Li, Na, K); n is an integer of 1 to 100; $A_2$ represents a univalent organic group such as an alkyl group having 6 to 50 (preferably, 6 to 35) carbon atoms (e.g. hexyl, heptyl, octyl, nonyl, decyl, undecyl and dodecy) and an aryl group substituted by an alkyl group having 2 to 35 carbon atoms or an alkenyl group having 2 to 35 carbon atoms. Preferred substituent to the aryl group include an alkyl group having 1 to 18 carbon atoms (e.g. unsubstituted alkyl groups such as methyl, propyl, butyl, pentyl, hexyl, heptyl, octyl, nonyl, decyl, undecyl and dodecyl), a substituted alkyl group such as benzyl and phenethyl, and an alkenyl having 2 to 20 carbon atoms (e.g. unsubstituted alkenyl group such as oleyl, cetyl and allyl, and substituted alkenyl group such as styryl). The aryl group includes phenyl, biphenyl and naphthyl, and preferably phenyl. The aryl group may be substituted at any position of ortho, meta and para.

Formula (VI)

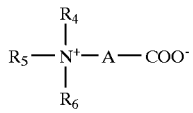

In the Formula, $R_4$, $R_5$ and $R_6$ each represent a substituted or unsubstituted alkyl group, and $R_4$ and $R_5$, or $R_5$ and $R_6$ may combine with each other to form a ring; A represents

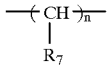

in which $R_7$ represents a hydrogen atom or an alkyl group, n is 1,2 or 3.

Formula (VII)

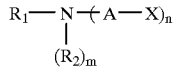

In the Formula (VII), $R_1$ is the same as defined in $A_2$ of Formula (I); $R_2$ represents a hydrogen atom or an alkyl group (e.g. methyl, ethyl); m and n are each an integer of 0, 1 or 2, provided that m plus n is 2; A represents an alkyl group or a substituted or unsubstituted aryl group; X represents -COOM or —$SO_3M$, in which M represents a hydrogen atom or an alkaline metal.

Formula (VIII)

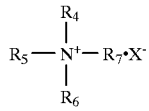

In the Formula, $R_4$, $R_5$, $R_6$ and $R_7$ each represent a substituted or unsubstituted alkyl group or phenyl group; $X^-$ represents an anion such as a halide ion, hydroxy ion, sulfate ion, carbonate ion, nitrate ion, acetate ion and p-toluenesulfonate ion.

Formula (IX)

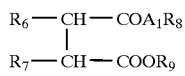

In the Formula, one of $R_6$ and $R_7$ represents a hydrogen atom or an alkyl group, and the other one represents —$SO_3M$, in which M represents a hydrogen atom or a univalent cation; $A_1$ represents an oxygen atom or —$NR_{10}$—, in which $R_{1o}$ represents a hydrogen atom or an alkyl group having 1 to 8 carbon atoms; $R_8$ and $R_9$ represents an alkyl group having 4 to 30 carbon atoms, provided that an alkyl group represented by $R_8$, $R_9$ and $R_{10}$ may be substituted by a fluorine atom.

Formula (X)

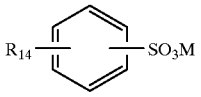

Formula (XI)

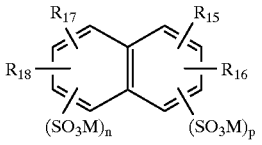

In the Formula, $R_{14}$, $R_{15}$, $R_{16}$, $R_{17}$ and $R_{18}$ each represent a hydrogen atom or an alkyl group; M is the same as defined in M of Formula (III); n and p represent an integer of 0, 1, 2, 3 or 4, provided that the relation of $1 \leqq n+p \leqq 8$ is satisfied.

Examples of the compounds represented by Formulas (I) to (XI) are shown below, but the compounds are not limited to these examples.

Compound represented by Formula (I)

I-1

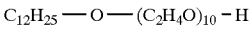

I-2

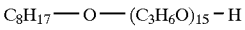

I-3

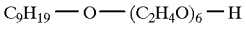

I-4

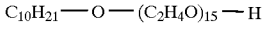

I-5

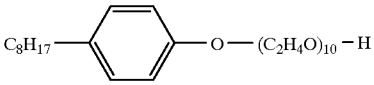

I-6

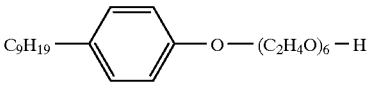

I-7

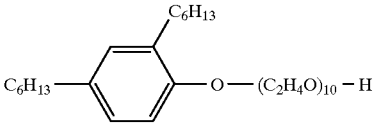

I-8

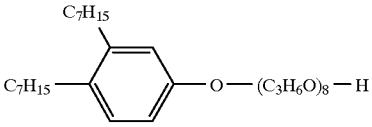

I-9

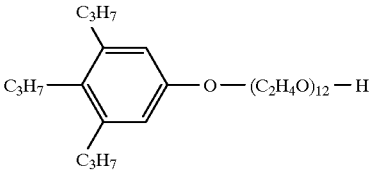

I-10

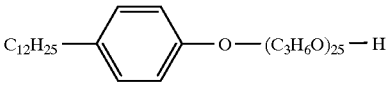

-continued

I-11

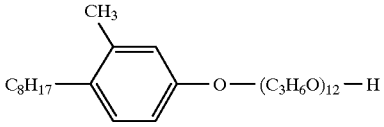

I-12

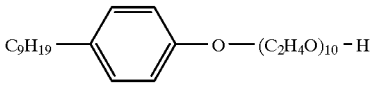

I-13

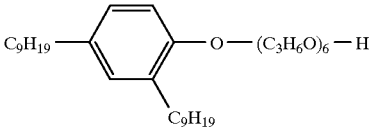

I-14

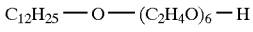

I-15

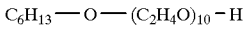

I-16

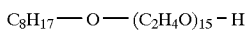

I-17

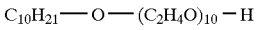

I-18

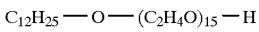

I-19

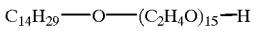

I-20

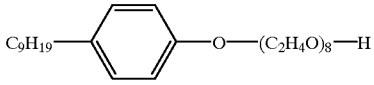

I-21

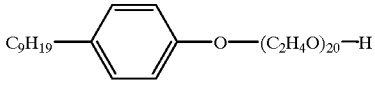

I-22

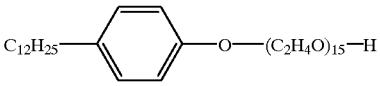

I-23

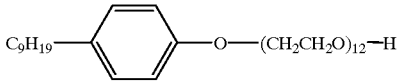

I-24

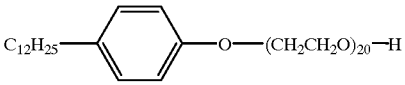

I-25

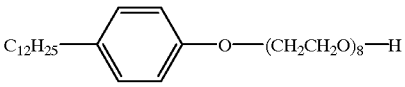

I-26

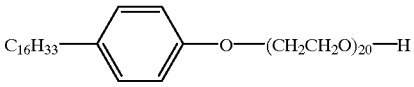

-continued

I-27

$CH_3(CH_2)_7CH{=}CH(CH_2)_7CH_2$—C$_6$H$_4$—O—$(CH_2CH_2O)_{30}$—H

I-28

$C_9H_{19}$—C$_6$H$_4$—O—$(CH_2CH_2O)_{20}$—H

I-29

$C_{12}H_{25}$—C$_6$H$_4$—O—$(CH_2CH_2O)_{47}$—H

I-30

$CH_3(CH_2)_7CH{=}CH(CH_2)_7CH_2$—C$_6$H$_4$—O—$(CH_2CH_2O)_{20}$—H

I-31

$C_9H_{19}$—C$_6$H$_4$—O—$(CH_2CH_2O)_{25}$—H

I-32

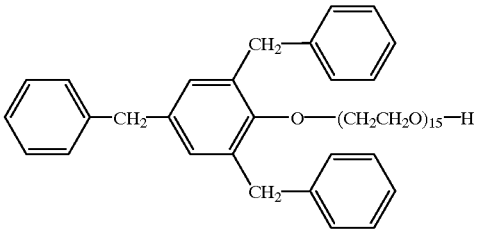

I-33

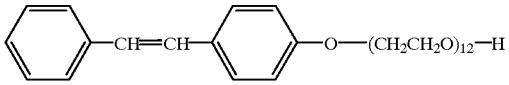

I-34

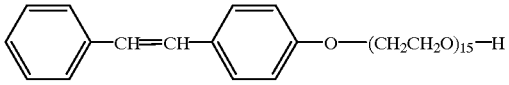

I-35

$C_8H_{17}$—C$_6$H$_4$—O—$(CH_2CH_2CH_2O)_{14}$—$(CH_2CH_2O)_{20}$—H

I-36

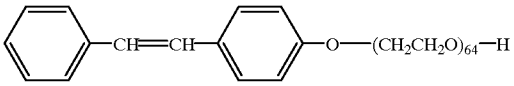

I-37

(*n*)$C_6H_{13}$—C$_6$H$_4$—O—$(CH_2$—$CH(OH)CH_2O)_{10}$—H

I-38

(*n*)$C_9H_{19}$—C$_6$H$_4$—O—$(CH_2$—$CH(OH)CH_2O)_8$—H

-continued

I-39

(*n*)$C_9H_{19}$—C$_6$H$_4$—O—$(CH_2$—$CH(OH)CH_2O)_{12}$—H

I-40

(*n*)$C_8H_{17}$—C$_6$H$_4$—O—$(CH_2$—$CH(OH)CH_2O)_{10}$—H

I-41

(*n*)$C_8H_{17}$—C$_6$H$_4$—O—$(CH_2$—$CH(OH)CH_2O)_{10}$—$(CH_2CH_2O)_8$—H

I-42

(*n*)$C_9H_{19}$—C$_6$H$_4$—O—$(CH_2$—$CH(OH)CH_2O)_8$—$(CH_2CH_2O)_1$—H

I-43

(*n*)$C_{10}H_{21}$—C$_6$H$_3$($CH_3$)—O—$(CH_2$—$CH(OH)CH_2)_7$—H

I-44

$(CH_3)_3C{\bullet}C_5H_{10}$—C$_6$H$_4$—O—$(CH_2$—$CH(OH)CH_2O)_{10}$—H

I-45

$CH_3$—C$_6$H$_4$—O—$(CH_2$—$CH(OH)CH_2O)_{10}$—H

I-46

(*n*)$C_{13}H_{27}$—O—$(CH_2CH_2O)_5$—H

I-47

$C_{12}H_{25}$—O—$(CH_2CH_2O)_{10}$—H

I-48

$C_{18}H_{37}$—O—$(CH_2CH_2O)_{10}$—H

I-49

(*n*)$C_{10}H_{21}$—O—$(CH_2CH_2O)_4$—H

I-50

(*n*)$C_{16}H_{33}$—O—$(CH_2CH_2O)_4$—H

I-51

(*n*)$C_{12}H_{25}$—O—$(CH_2$—$CH(OH)CH_2O)_{10}$—H

I-52

(*n*)$C_{12}H_{25}$—O—$(CH_2$—$CH(OH)CH_2O)_2$—$(CH_2CH_2O)_8$—H

I-53

(*n*)$C_{13}H_{27}$—O—$(CH_2CH_2O)_4$—H

I-54

(iso)$C_{12}H_{25}$—C$_6$H$_4$—O—$(CH_2$—$CH(OH)CH_2O)_7$—H

-continued
I-55
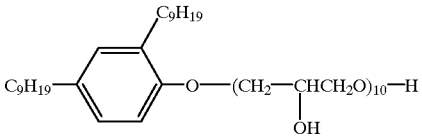
I-56
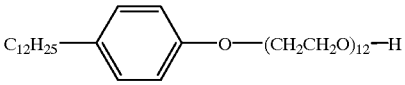
I-57
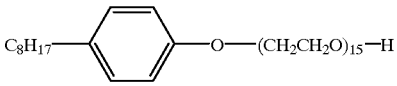
I-58
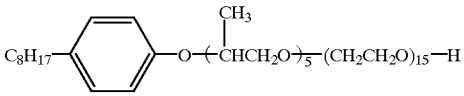
I-59
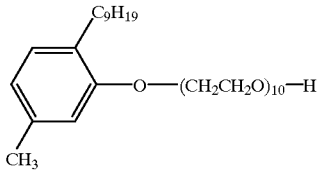
I-60
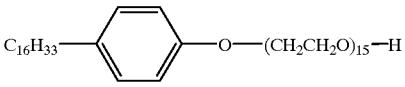
I-61
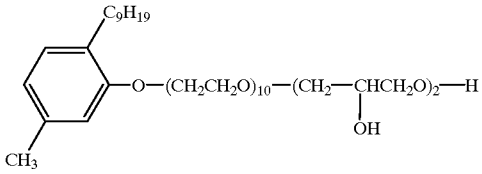
I-62
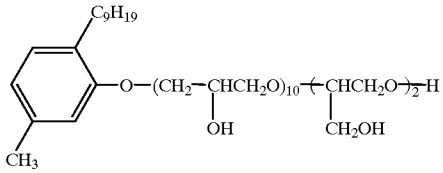
I-63
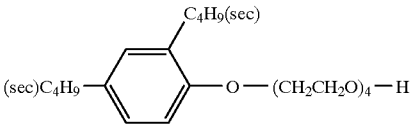
I-64
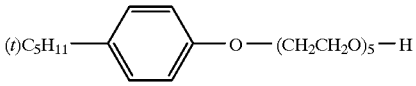
I-65
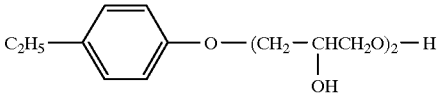
-continued
I-66
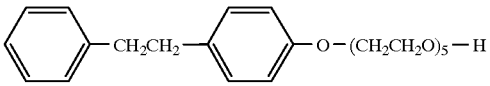
I-67
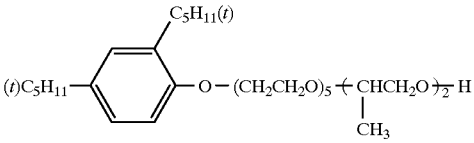
I-68
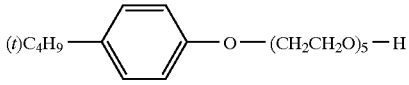
I-69
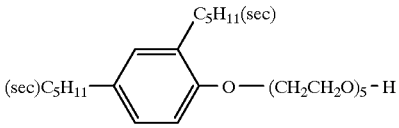
I-70
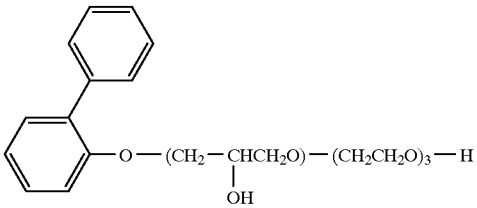
I-71
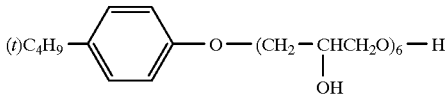
I-72
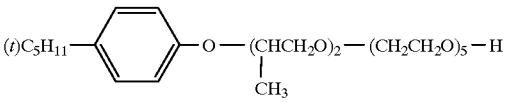
I-73
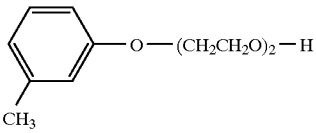
I-74
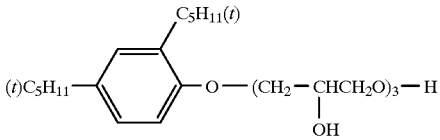
I-75
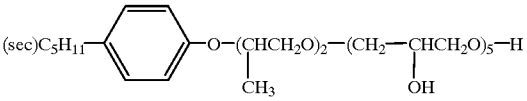
I-76
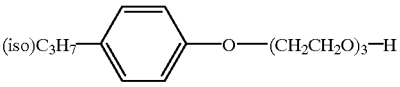

-continued

I-77

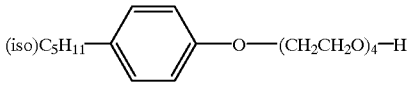

I-78

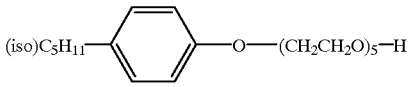

Compound represented by Formula (II)

II-1 $C_{12}H_{25}COO—(C_2H_4O)_{10}—H$

II-2 $C_6H_{13}COO—(C_2H_4O)_4—H$

II-3 $C_{12}H_{25}NH—(C_2H_4O)_{10}—H$

II-4 $C_{12}H_{25}NH—(C_2H_4O)_{15}—H$

II-5 $HO—(C_2H_4O)_{20}—(CH(CH_3)CH_2O)_5—(C_2H_4O)_{20}—H$

II-6 $C_{12}H_{25}—NHCH_2CH_2OH$

II-7 $C_{12}H_{25}—N(CH_2CH_2O)_{10}—H)(CH_2CH_2O)_{10}—H)$

II-8 $C_{12}H_{25}—N(CH_2CH_2O)_5—H)(CH_2CH_2O)_5—H)$

Compound represented by Formula (III)

III-1 $C_{12}H_{25}—SO_2NHCH_2CH_2COONa$

III-2 $C_{12}H_{25}COONa$

III-3 $C_{12}H_{27}COOK$

III-4 $C_{17}H_{33}CONHCH_2CH_2COONa$

III-5 $C_{17}H_{33}CON(CH_3)—CH_2COONa$

III-6 $C_{17}H_{33}CON(CH_3)—CH_2COOH$

Compound represented by Formula (IV)

IV-1 $C_{12}H_{25}SO_3Na$

IV-2 $C_{11}H_{23}CONHCH_2CH_2OSO_3Na$

IV-3 $C_{12}H_{25}CONH—(CH_2CH_2O)_n—CH_2CH_2OSO_3Na$

-continued

IV-4 $C_{12}H_{25}OSO_3Na$

IV-5 $C_{11}H_{23}COOCH_2CH(OH)CH_2OSO_3Na$

IV-6 $C_{11}H_{23}—CO—N(CH_3)—CH_2CH_2SO_3Na$

IV-7 $C_{15}H_{31}—CO—N(CH_2CH_2OH)—CH_2CH_2SO_3Na$

IV-8 $C_{17}H_{35}—CO—N(C_6H_5)—CH_2CH_2SO_3Na$

IV-9 $C_{17}H_{35}—CO—N(C_4H_9)—CH_2CH_2SO_3K$

IV-10 $C_{11}H_{23}—CO—N(CH_3)—CH_2SO_3Na$

IV-11 $C_{15}H_{31}—CO—N(CH_3)—CH_2CH_2SO_3Na$

Compound represented by Formula (V)

V-1 $C_9H_{19}O(C_2H_4O)_4SO_3Na$

V-2 $C_{10}H_{21}O(C_2H_4O)_{15}SO_3Na$

V-3

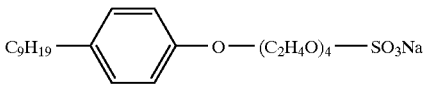

V-4

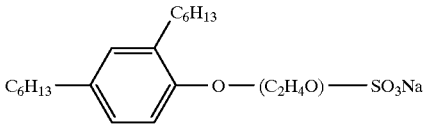

V-5

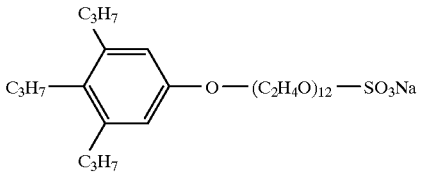

V-6

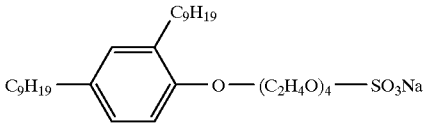

V-7 $C_{12}H_{25}O—(C_2H_4O)_4—SO_3Na$

-continued
V-8
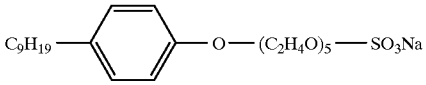
Compound represented by Formula (VI)
VI-1
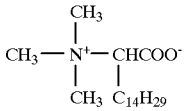
VI-2
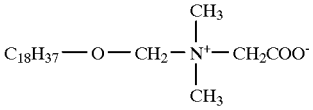
VI-3
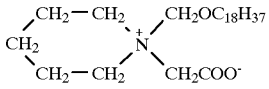
VI-4
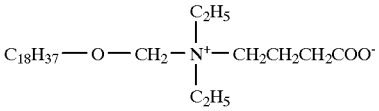
VI-5
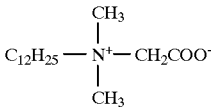
VI-6
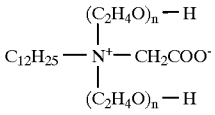
Compound represented by Formula (VII)
VII-1
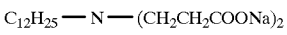
VII-2
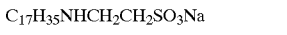
VII-3
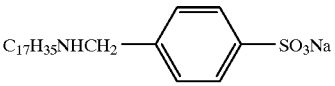
Compound represented by Formula (VIII)
VIII-1
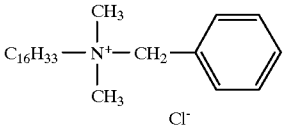
-continued
VIII-2
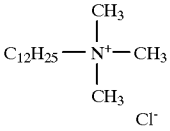
VIII-3
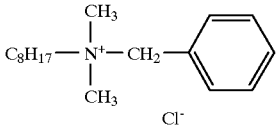
VIII-4
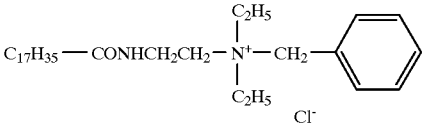
VIII-5
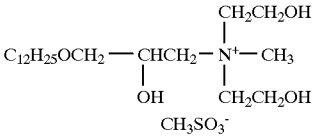
VIII-6
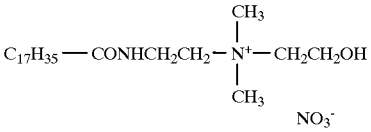
VIII-7
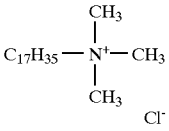
VIII-8
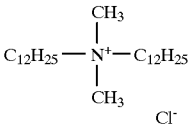
VIII-9
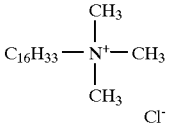
VIII-10
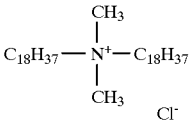
VIII-11
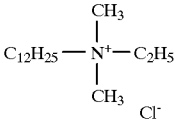

-continued
VIII-12
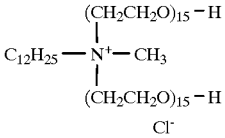
VIII-13
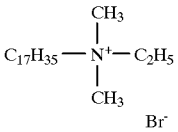
VIII-14
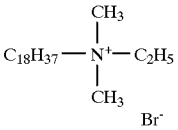
VIII-15
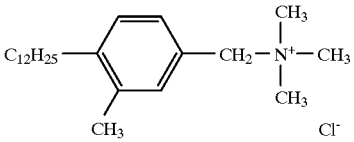
VIII-16
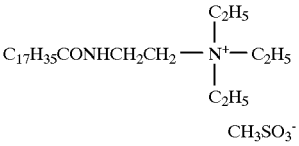
VIII-17
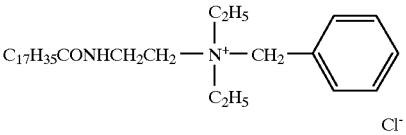
VIII-18
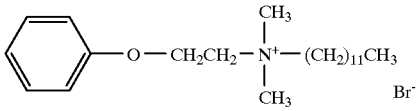
VIII-19
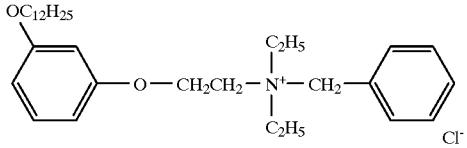
VIII-20
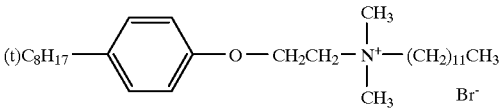
VIII-21
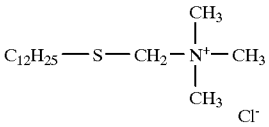
-continued
VIII-22
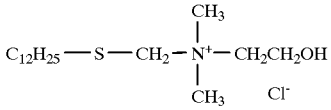
VIII-23
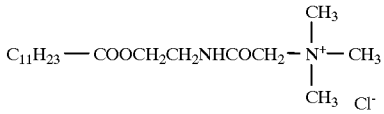
VIII-24
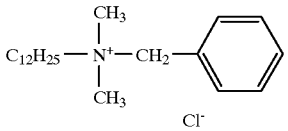
VIII-25
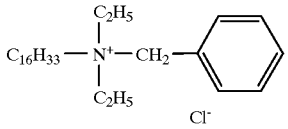
VIII-26
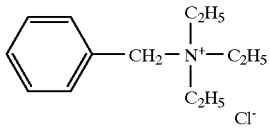
VIII-27
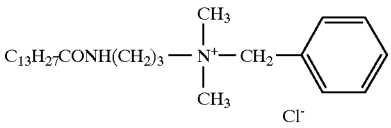
Compound represented by Formula (IX)
IX-1
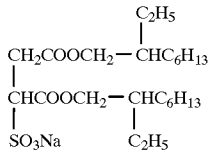
IX-1
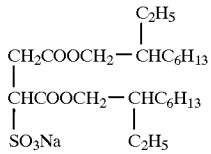
IX-2
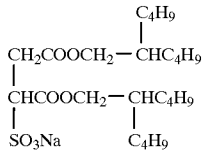

-continued
IX-3
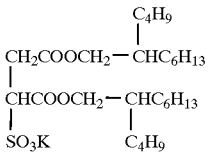
IX-4
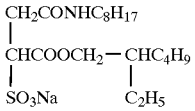
IX-5
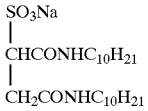
IX-6
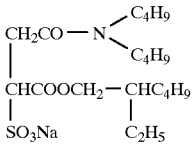
IX-7
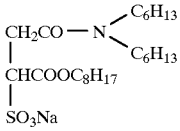
IX-8
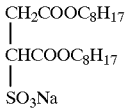
IX-9
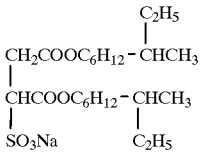
IX-10
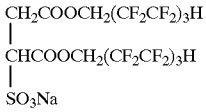
IX-11
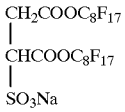
IX-12
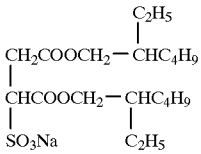
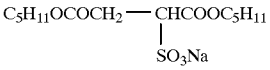
-continued
IX-13
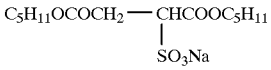
IX-14
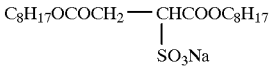
IX-15
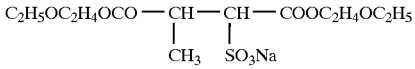
IX-16
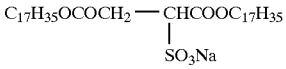
IX-17
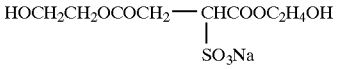
Compound represented by Formula (X)
X-1
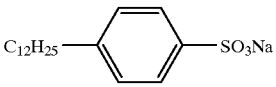
X-2
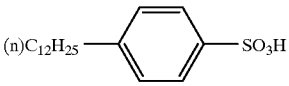
Compound represented by Formula (XI)
XI-1
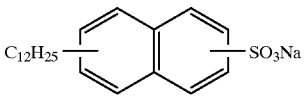
XI-2
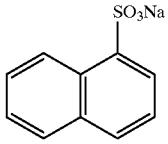
XI-3
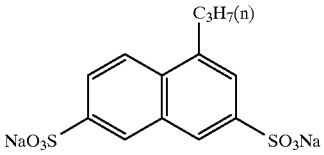
XI-4
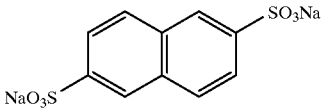
XI-5
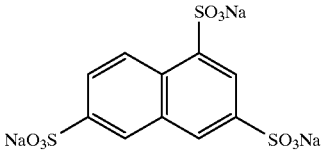

-continued

XI-6

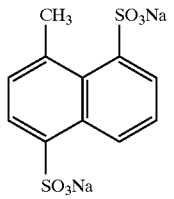

XI-7

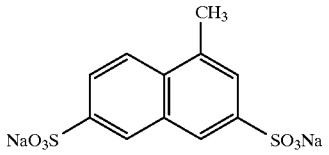

XI-8

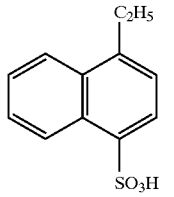

XI-9

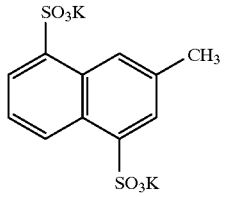

XI-10

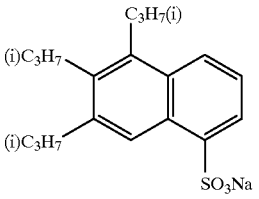

XI-11

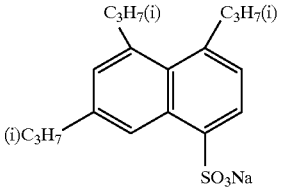

The aqueous soluble surfactant is contained preferably in an amount of 0.05 to 20 g/l, and more preferably 0.25 to 15 g/l, in which marked effects of the invention is displayed and occurrence of foaming is little. The aqueous soluble surfactant is used singly or in combination of two or more. The first processing solution or the second processing solution according to the invention may contain previously the aqueous soluble surfactant or may contain the surfactant which is leached out of a photographic material during processing, and it is preferred that the first or second processing solution previously contains the aqueous soluble surfactant.

The aqueous soluble surfactant usable in the invention is preferably a nonionic or anionic surfactant, and more preferably a nonionic surfactant. Further, an embodiment in which the aqueous soluble surfactant is contained in the second processing solution containing an oxidizing agent, enhances the effect of the invention and is preferable.

In the invention, the first processing solution or the second processing solution preferably contains a compound represented by the following formula (B):

Formula (B)

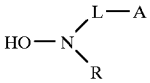

wherein L represents an alkylene group, which may be substituted; A represents a carboxy group, a sulfo group, a phosphono group, a phosphinate group, a hydroxy group, an amino group, which may be substituted with an alkyl group, an ammonio group, which may be substituted with an alkyl group, a carbamoyl group, which may be substituted with an alkyl group, or a sulfamoyl group, which may be substituted with an alkyl group; and R represents a hydrogen atom or an alkyl group, which may be substituted.

It was found that graininess was improved by allowing the compound represented by formula (B) to be contained in the first or second processing solution. Although the mechanism has not been clarified, it is presumed that the presence of the compound suppresses local production of a large amount of an oxidation product of a color developing agent formed on reaction with an oxidizing agent used for amplification.

In Formula (B), L represents a straight-chained or branched alkylene group having 1 to 10 carbon atoms, which may be substituted, including methylene, ethylene, trimethylene and propylene. Examples of a substituent include a carboxy group, sulfo group, phosphono group, phosphinate group, hydroxy group, ammonio group, which may be substituted, and of these are preferred a carboxy group, sulfo group, phosphono group, and hydroxy group. A represents a carboxy group, a sulfo group, a phosphono group, a phosphinate group, a hydroxy group, an amino group, which may be substituted with an alkyl group, an ammonio group, which may be substituted with an alkyl group, a carbamoyl group, which may be substituted with an alkyl group, or a sulfamoyl group, which may be substituted with an alkyl group, and of these are preferred a carboxy group, sulfo group, hydroxy group phosphono group and a carbamoyl group which may be substituted. More concretely, preferred examples of —L—A include carboxymethyl, carboxyethyl, carboxypropyl, sulfoethyl, sulfopropyl, sulfobutyl, phosphonomethyl, phosphonoethyl, and hydroxyethyl. Carboxymethyl, carboxyethyl, sulfoethyl, sulfopropyl, phosphonomethyl and phosphonoethyl are more preferable. R represent a hydrogen atom or a straight or branched alkyl group having 1 to 10 carbon atoms (more preferably, 1 to 5 carbon atoms), which may be substituted. Examples of a substituent include a carboxy group, a sulfo group, a phosphono group, a phosphinate group, a hydroxy group, an amino group, which may be substituted with an alkyl group, an ammonio group, which may be substituted with an alkyl group, a carbamoyl group, which may be substituted with an alkyl group, or a sulfamoyl group, which may be substituted with an alkyl group. The substituent may be one or more. Preferred examples of R include a hydrogen atom, carboxymethyl, carboxyethyl, carboxypropyl, sulfoethyl, sulfopropyl, sulfobutyl, phosphonomethyl, phosphonoethyl and hydroxyethyl, and a hydrogen atom, carboxymethyl, carboxyethyl, sulfoethyl, sulfopropyl, phosphonomethyl and phosphonoethyl are more preferred. L and R may combine with each other to form a ring.

Exemplary examples of the compound represented by Formula (B) are shown below, bur the compound is not limited to these examples.

B-1
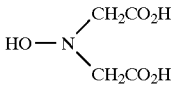
B-2
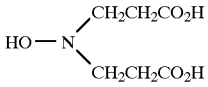
B-3
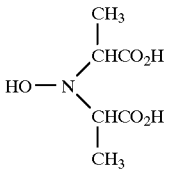
B-4
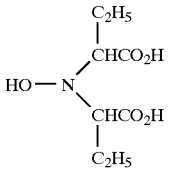
B-5
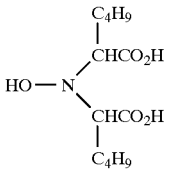
B-6
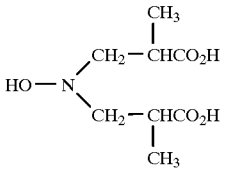
B-7
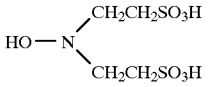
B-8
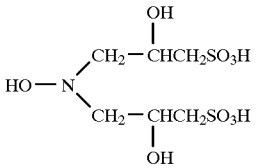
B-9
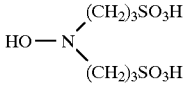
B-10
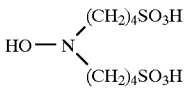
B-11
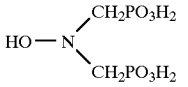
-continued
B-12
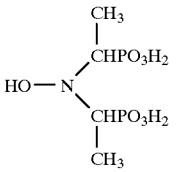
B-13
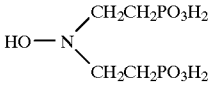
B-14
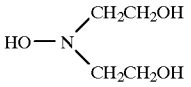
B-15
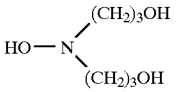
B-16
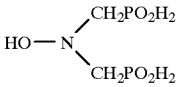
B-17
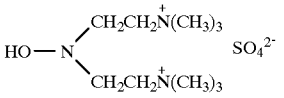
B-18
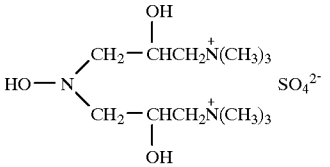
B-19
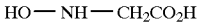
B-20
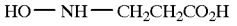
B-21
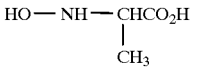
B-22
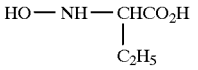
B-23
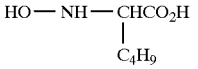
B-24
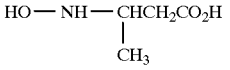
B-25
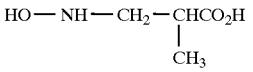
B-26
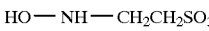
B-27
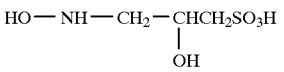

-continued

B-28

$HO-NH-(CH_2)_3SO_3H$

B-29

$HO-NH-(CH_2)_4SO_3H$

B-30

$HO-NH-CH_2PO_3H_2$

B-31

$HO-NH-CH(CH_3)PO_3H_2$

B-32

$HO-NH-CH_2CH_2PO_3H_2$

B-33

$HO-NH-CH_2CH_2OH$

B-34

$HO-NH-(CH_2)_3OH$

B-35

$HO-NH-CH_2-PO_3H_2$

B-35

$HO-NH-CH_2-PO_3H_2$

B-36

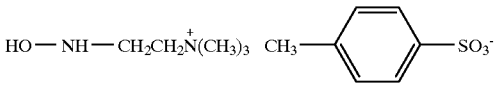

B-37

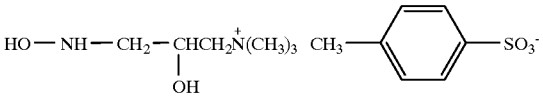

B-38

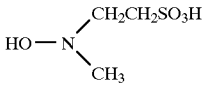

B-39

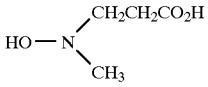

B-40

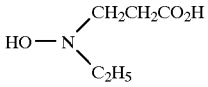

B-41

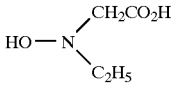

B-42

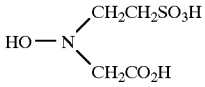

B-43

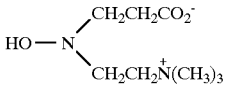

B-44

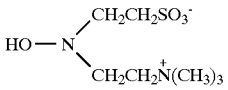

B-45

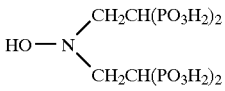

-continued

B-46

$HONHCH_2CH(PO_3H_2)_2$

B-47

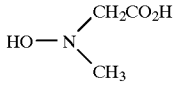

B-48

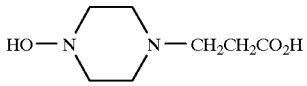

B-49

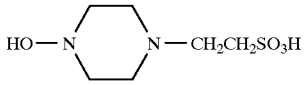

B-50

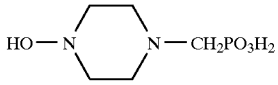

B-51

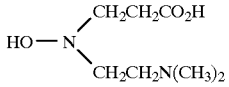

B-52

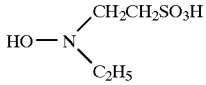

B-53

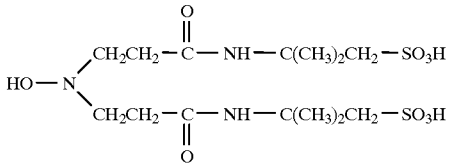

B-54

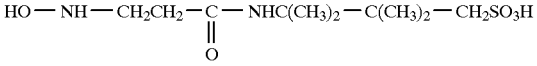

B-55

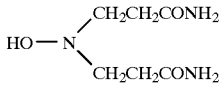

The compound represented by Formula (B) is contained preferably in an amount of $1.5\times10^{-3}$ to $1.5\times10^{-1}$ mol/l, and more preferably $3.0\times10^{-3}$ to $9.0\times10^{-2}$ mol/l. The compound may be used singly or in combination of two or more. The first processing solution or the second processing solution according to the invention may contain previously the compound or may contain the compound which is leached out of a photographic material during processing, and it is preferred that the first or second processing solution previously contains the compound. Further, an embodiment in which the compound is contained in the first processing solution containing a color developing agent, enhances the effect of the invention and is preferable.

The compound represented by Formula (B) can be synthesized by subjecting commercially available hydroxylamines to alkylation reaction (nucleophilic substitution reaction, addition reaction, Mannich reaction, etc.), for example, according to the method described in West German Patent 1159634, and "Inorganica Chimica Acta" 93 (1984) 101–107.

The first processing solution or second processing solution according to the invention preferably contains an aqueous soluble coupler capable of coupling reaction with a color developing agent. The aqueous soluble coupler is defined as one, 1 mmol or more of which is soluble in 1 liter of an aqueous solution at 25° C. which is prepared by dissolving anhydrous potassium carbonate in a concentration of 20 g/l and adjusting the pH to 10.0 with sulfuric acid or potassium hydroxide.

The aqueous soluble coupler preferably contain, within its molecule, at least one of a sulfo group, carboxy group, hydroxy group and amino group to enhance aqueous solubility. Of these groups, the sulfo group, carboxy group and hydroxy group may form a salt such as an alkaline metal salt (lithium, sodium, potassium, etc.), an ammonium salt, an organic base salt (pyridinium, guanidium, piperidinium, triethylammonium, triethanolamine salt, etc.). The amino group may form a salt with an inorganic acid or organic acid (hydrochloric acid, sulfuric acid, sulfurous acid, carboxylic acids, phospholic acids, p-toluenesulfonic acid, etc.).

It is preferred that the aqueous soluble coupler and its reaction product with an oxidized color developing agent do not remain finally in the image-formed photographic material. Therefore, the aqueous soluble coupler and its reaction product with an oxidized color developing agent may have any spectral absorption or be colorless. The molecular weight of the aqueous soluble coupler is preferably less than 1,000, and more preferably less than 500. Of the aqueous soluble couplers more preferred is one which has the solubility described above not only under the alkaline condition but also under the neutral condition.

Of the aqueous soluble couplers preferred is a compound represented by the following formula (1) or (2):

Formula (1)

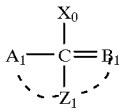

Formula (2)

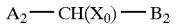

wherein $X_0$ represents a hydrogen atom, an alkyl group or a group capable of being released upon reaction with an oxidation product of a color developing agent; $A_1$ and $B_1$ each represents a nitrogen atom or a carbon atom; $Z_1$ represents an atomic group necessary to form a ring with $A_1—C(X_0)=B_1$; $A_2$ and $B_2$ each represent $=COR^{11}$, —CN, $—C(R^{12})=NR^{11}$, $—CSR^{11}$, $—NO_2$, $—N(R^{11})(R^{12})$, $—N^+(R^{11})(R^{12})(R^{13})$, $—SO_2R^{11}$ or an aryl group, and $A_2$ and $B_2$ may combine with each other to form a ring; $R^{11}$, $R^{12}$ and $R^{13}$ each represent a hydrogen atom or a univalent organic group The alkyl group represented by $X_0$ is preferably one having 1 to 10 carbon atoms, which may be straight-chained or branched and be substituted. Examples of the group represented by $X_0$, which is capable of being released upon reaction with an oxidation product of a color developing agent, include a halogen atom (e.g. chlorine, bromine, iodine atoms), alkoxy, aryloxy, heterocyclic-oxy, acyloxy, sulfonyloxy, alkoxycarbonyloxy, aryloxycarbonyl, alkyloxalyloxy, alkoxyoxalyloxy, alkylthio, arylthio, heterocyclic-thio, alkyloxythio, carbonylthio, acylamino, sulfonamido, nitrogen containing heterocyclic group capable of bonding at the N atom, alkyloxycarbonylamino, aryloxycarbonylamino, carboxyl and

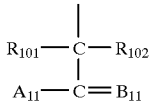

where $A_{11}$ and $B_{11}$ are respectively the same as defined in $A_1$ and $B_1$, $R_{101}$ and $R_{102}$ each represent a hydrogen atom, an alkyl group, an aryl group or a heterocyclic group. Of these, $X_0$ is preferably a hydrogen atom.

The compound represented by Formula (1) is concretely represented by the following Formulas (1-1) to (1-6):

Formula (1-1)

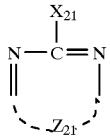

Formula (1-2)

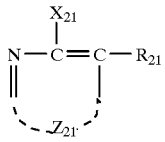

Formula (1-3)

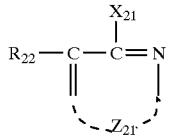

Formula (1-4)

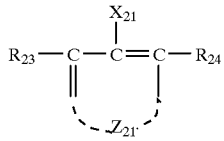

Formula (1-5)

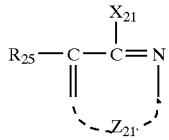

Formula (1-6)

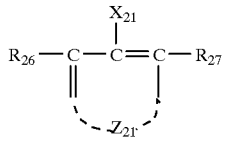

wherein $X_{21}$ and $Z_{21}$ each are respectively the same as defined in $X_0$ and $Z_1$; $R_{21}$, $R_{22}$, $R_{23}$, $R_{24}$ and $R_{27}$ represent a hydrogen atom or a univalent organic group, and examples of the univalent organic group represented by $R_{21}$, $R_{22}$, $R_{23}$, $R_{24}$ and $R_{27}$ include a halogen atom, alkyl, cycloalkyl, alkenyl, cycloalkenyl, alkynyl, aryl, heterocyclic group, acyl, sulfonyl, sulfinyl, phosphonyl, carbamoyl, sulfamoyl, cyano, spiro-compound residue, bridged hydrocarbon compound residue, alkoxy, aryloxy, heterocyclic-oxy, siloxy, acyloxy, carbamoyloxy, amino, sulfonamido, ureido, sulfamoylamino, alkoxycarbonylamino, aryloxycarbonylamino, alkoxycarbonyl, aryloxycarbonyl, alkylthio, arylthio, heterocyclic-thio, sulfo, nitro, carboxyl, and hydroxyl; $R_{25}$ and $R_{26}$ each represent an oxygen atom, sulfur atom, or a bivalent organic group capable of bonding through a carbon atom or nitrogen atom. Structures represented by Formulas (1-2), (1-3) and (1-5) are in conjugation with each other, and those of Formulas (1-4) and (1-6) are also in conjugation with each other. $Z_{21}$ represents an atomic group necessary to form a ring with $=N—C(X_{21})=N—$, $=N—C(X_{21})=C(R_{21})—$, $=C(R_{22})—C(X_{21})=N—$, $=C(R_{23})—C(X_{21})=C(R_{24})—$, $—C(=R_{25})—C(X_{21})=N—$ or $—C(=R_{26})—C(X_{21})=C(R_{27})—$. The atomic group is preferably comprised of a carbon atom, hydrogen atom, oxygen atom or nitrogen atom. The formed ring is preferably a 5 or 6-membered ring, which may be substituted. The substituents are those represented by $R_{21}$, $R_{22}$, $R_{23}$, $R_{24}$ and $R_{27}$. $Z_{21}$ may combine with $R_{21}$ to $R_{27}$ to form a ring.

In Formula (2), $X_0$ is the same as defined in Formula (1)

$A_2$ and $B_2$ each represent $=COR^{11}$, $=CN$, $—C(R^{12})=NR^{11}$, $—CSR^{11}$, $—NO_2$, $—N(R^{11})(R^{12})$, $—N^+(R^{11})(R^{12})(R^{13})$, $—SO_2R^{11}$ or an aryl group. Of these, $A_2$ and $B_2$ are preferably combined so as to form an active couplers described in T. H. James, The Theory of the Photographic Process, 3rd edition, page 388, Fig.17.6. The univalent organic groups represented by $R^{11}$, $R^{12}$ and $R^{13}$ are the same as those represented by $R_{21}$, $R_{22}$, $R_{23}$, $R_{24}$ and $R_{27}$. $R^{11}$ and $R^1$ may combine with each other to form a ring. $A_2$ and $B_2$ may combine with each other to form a ring. The ring formed is preferably a 5- or 6-membered one. When $A_2$ and $B_2$ combine to form a ring, it is sometimes in conjugation with the structure represented by Formula (1).

More preferable aqueous soluble couplers are represented by the following Formulas (3) to (11):

Formula (3)

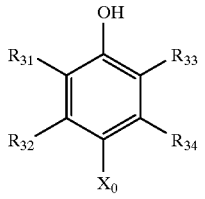

Formula (4)

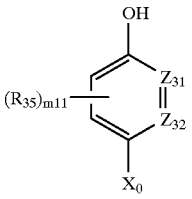

Formula (5)

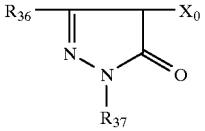

Formula (6)

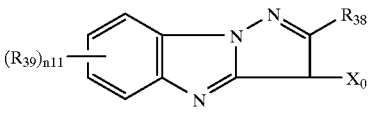

-continued

Formula (7)

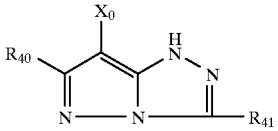

Formula (8)

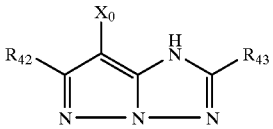

Formula (9)

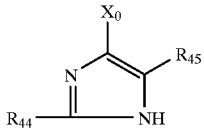

Formula (10)

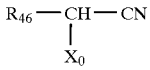

Formula (11)

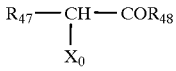

wherein $X_0$ is the same as defined in Formula (1); $R_{31}$ to $R_{45}$ and $R_{48}$ each represent a hydrogen atom or a univalent organic group, and the univalent organic group is the same as defined in $R_{21}$, $R_{22}$, $R_{23}$, $R_{24}$ and $R_{27}$; $R_{46}$ and $R_{47}$ each represent $—CN$, $—C(R^{12})=NR^{11}$, $—N^+(R^{11})(R^{12})(R^{13})$,

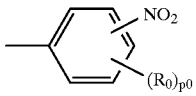

or $—COR^{11}$, in which $R^{11}$, $R^{12}$ and $R^{13}$ are the same as defined in Formula (2), $R^{11}$ and $R^{12}$ may combine with each other to form a ring, $R_0$ represents a hydrogen atom or a univalent organic group, $p_0$ represents an integer of 0 to 4, provided that when $P_0$ is 2 or more, plural Ros may be the same with or different from each other.

One of $Z_{31}$ and $Z_{32}$ represents $—N=$ and the other one represents $=C(R_{49})—$, in which $R_{49}$ is the same as defined in $R_{35}$ and represents a hydrogen atom or a univalent organic group; $m_{11}$ represents an integer of 0 to 2, provided that when $m_{11}$ is 2, two $R_{35}$s may be the same with or different from each other; $n_{11}$ represents an integer of 0 to 4, provided that when $n_{11}$ is 2 or more plural $R_{39}$s may be the same with or different from each other.

In Formula (3), $R_{31}$ and $R_{32}$, and/or $R_{33}$ and $R_{34}$ may combine with each other to form a ring. Further, at least one of sulfo, carboxyl, hydroxyl and amino groups is preferably contained in a group represented by $R_{311}$ $R_{32}$, $R_{33}$ and $R_{34}$ of Formula (3), a group represented by $R_{35}$ of Formula (4), a group represented by $R_{36}$ and $R_{37}$ of Formula (5), a group represented by $R_{38}$ and $R_{39}$ of Formula (6), a group represented by $R_{40}$ and $R_{41}$ of Formula (7),
a group represented by $R_{342}$ and $R_{43}$ of Formula (8),
a group represented by $R_{44}$ and $R_{45}$ of Formula (9),
a group represented by $R_{46}$ of Formula (10), and
a group represented by $R_{47}$ and $R_{48}$ of Formula (11).

Of the aqueous soluble couplers represented by Formulas (3) to (11) preferred are those represented by Formulas (3), (4) and (5).

Examples of the aqueous soluble couplers are shown below, but the couplers are not limited to these examples.

| Compd. | R (sub.position) |
|---|---|
| | 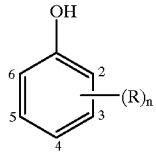 |
| 1 | —OH(3) |
| 2 | —$NH_2$(3) |
| 3 | —$CH_2COOH$(2) |
| 4 | —$CH_2COOH$(3) |
| 5 | —CH═CHCOOH(2) |
| 6 | —CH═CHCOOH(3) |
| 7 | —$CH_2OH$(2) |
| 8 | —$CH_2OH$(3) |
| 9 | —$NHCOCH_3$(2) |
| 10 | —$NHCOCH_3$(3) |
| 11 | —$OCH_3$(3) |
| 12 | —$OCH_3$(2), —$NH_2$(5) |
| 13 | —$NHCONH_2$(2) |
| 14 | —$NHCOCH_2CH_2COOH$(2) |
| 15 | 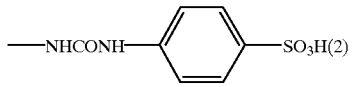 |
| 16 | —$OCH_2COOH$(3) |
| 17 | —$NHCOCH_2CH_2COOH$(2,5) |
| 18 | 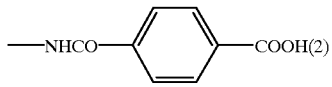 |
| 19 | 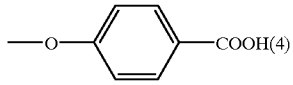 |
| 20 | —$CH_2COOH$(2), —Cl(4) |
| 21 | 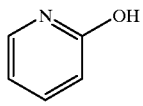 |
| 22 | 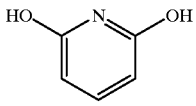 |
| 23 | 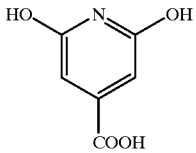 |

-continued

24

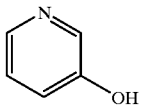

25

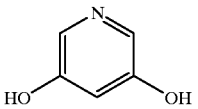

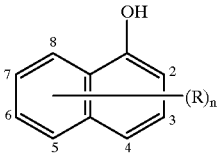

26 —$NH_2$(5)
27 —$NHCONH_2$(5)
28 —$NHCOCH_2CH_2COOH$(5)
29 —$NHSO_2CH_3$(5)
30 —$SO_3H$(5), —$NH_2$(8)
31 —$SO_3H$(5), —$NHCOOCH_3$(8)

32

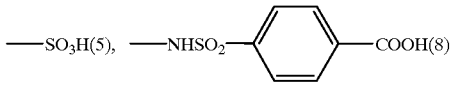

33 —$SO_3Na$(3,6)
34 —$SO_3K$(2)
35 —$SO_3Na$(3)
36 —$SO_3Na$(5)
37 —$SO_3Na$(8)
38 —OH(3)
39 —OH(6)
40 —OH(5)
41 —$NH_2$(7)
42 —$NHCONH_2$(7)
43 —$NHCOCH_2CH_2COOH$(7)
44 —$NHCOOCH_3$(7)
45 —$SO_3H$ or —$SO_3Na$(5,7), —$NH_2$(8)
46 —$SO_3H$ or —$SO_3Na$(5,7), —$NHCOCH_3$(8)
47 —$SO_3H$ or —$SO_3Na$(5,7), —$NHCOCH_2OH$(8)
48 —$SO_3H$ or —$SO_3Na$(3,6), —$NH_2$(8)
49 —$SO_3H$ or —$SO_3Na$(3,6), —$NHCOCH_3$(8)
50 —$NH_2$.HCl(2)
51 —$NHCOCH_2CH_2COOH$(2)
52 —$NHCOCH(OH)_2$(2)
53 —$NHCONH_2$(2)
54 —$NHCOCH_3$(2), —$SO_3Na$(5)
55 —$SO_3H$(3), —$NH_2$(5)
56 —$SO_3H$(3), —$NHCOOCH_3$(5)
57 —$SO_3H$(3), —$NHCONH_2$(5)
58 —$SO_3H$(3), —$NH_2$(6)
59 —$SO_3H$(3), —$NHCOCH_3$(6)
60 —$SO_3H$(3), —$NH_2$(7)
61 —$SO_3H$(3), —$NHCOOCH_3$(7)
62 —$CONHCH_2CH_2COOH$(2)
63 —$CONHCH_2CH_2OH$(2)
64 —$CONH_2$(2), —OH(5)

65

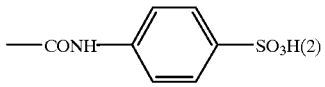

66 —$SO_3H$(3,6), —OH(8)
67 —$SO_3H$(3,6,8)
68 —$SO_3H$(4,8)
69 —Cl(4), —$SO_3Na$(5)
70 —$SO_3Na$(3,6), —Cl(4)

-continued
| | |
|---|---|
| 71 | —CONHCH$_2$CH$_2$COOH(2), —O— 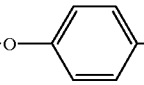 —NHCOCH$_2$CH$_2$COOH(4) |
| 72 | —OCH$_2$CONHCH$_2$CH$_2$OH(4), —SO$_3$Na(5) |
| 73 | 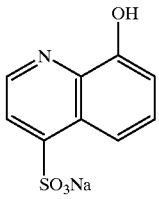 |
| 74 | 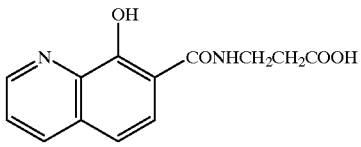 |
| 75 | 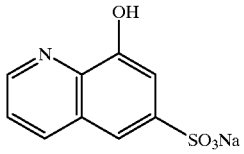 |
| 76 | 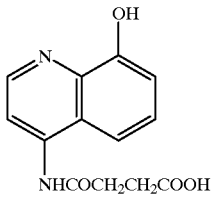 |
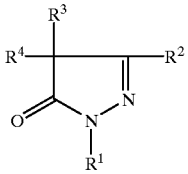
| Compd. | R$^1$ | R$^2$ | R$^3$ | R$^4$ |
|---|---|---|---|---|
| 77 | 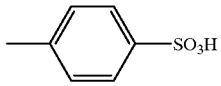 | —CH$_3$ | H | H |
| 78 | 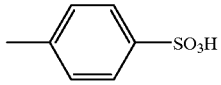 | 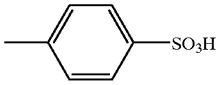 | H | H |
| 79 | 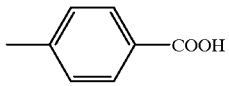 | —CH$_3$ | H | H |
| 80 | 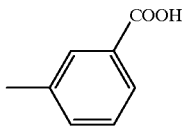 | —CH$_3$ | H | H |

-continued
| | | | | |
|---|---|---|---|---|
| 81 | 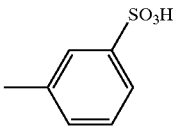 | —NHCOCH$_3$ | H | H |
| 82 | 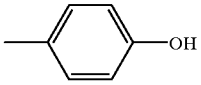 | —CH$_3$ | H | H |
| 83 | 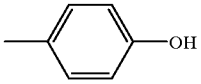 | —NHCH$_3$ | H | H |
| 84 | 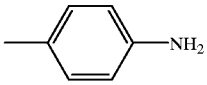 | —OH | H | H |
| 85 | 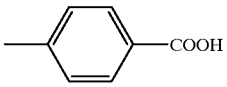 | —OH | H | H |
| 86 | 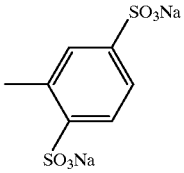 | —CH$_3$ | H | H |
| 87 | 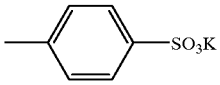 | —COOH | H | H |
| 88 | 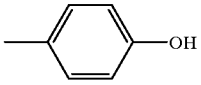 | —CN | H | H |
| 89 | 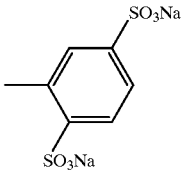 | —CONH$_2$ | H | H |
| 90 | 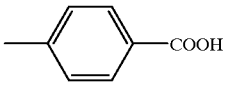 | —NHCOCH$_3$ | H | H |
| 91 | —CH$_3$ | 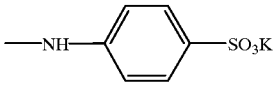 | H | H |
| 92 | —CH$_3$ | 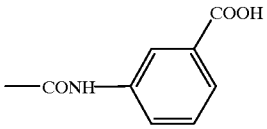 | H | H |

-continued
| | | | | |
|---|---|---|---|---|
| 93 | 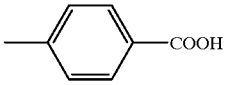 | —$NH_2$ | H | H |
| 94 | —$CH_3$ | —$NHCOCH_2CH_2COOH$ | H | H |
| 95 | —$CH_3$ | 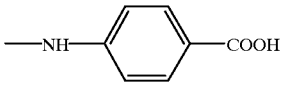 | H | H |
| 96 | —$CH_3$ | —$COO(CH_2CH_2O)_2H$ | H | H |
| 97 | 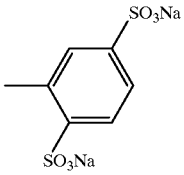 | —$COOC_2H_5$ | H | H |
| 98 | —$CH_3$ | —COOH | H | H |
| 99 | —$CH_3$ | 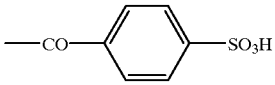 | H | H |
| 100 | 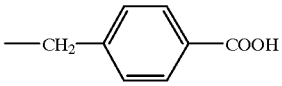 | —OH | H | H |
| 101 | 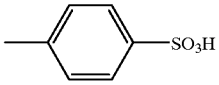 | 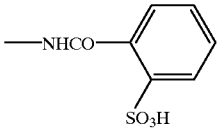 | H | H |
| 102 | 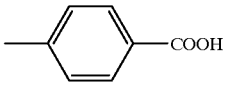 | 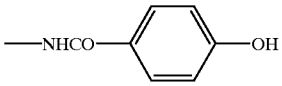 | —$CH_3$ | H |
| 103 | 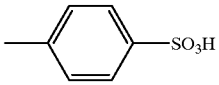 | —$CH_3$ | —$CH_3$ | H |
| 104 | —$CH_3$ | —OH | —$C_2H_5$ | H |
| 105 | —$CH_3$ | —$NHCOCH_2CH_2COOH$ | —$CH_3$ | H |
| 106 | 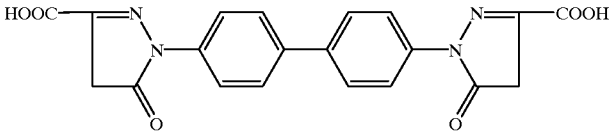 | | | |

-continued
107
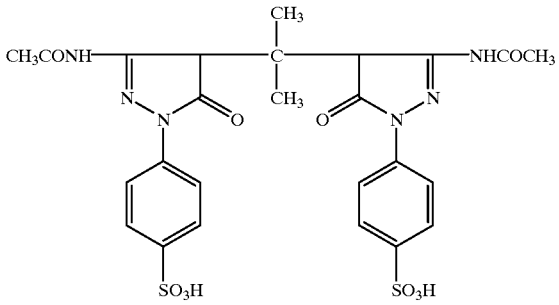
108
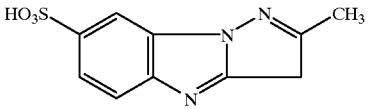
109
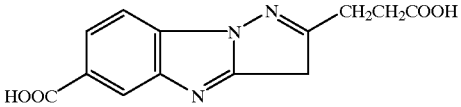
110
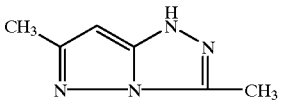
111
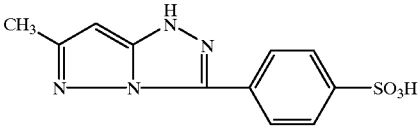
112
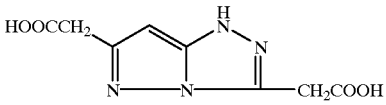
113
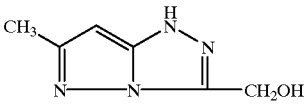
114
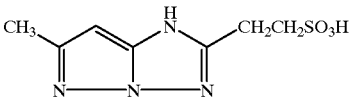
115
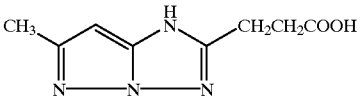
116
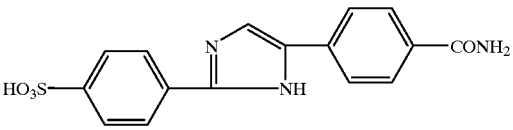
117
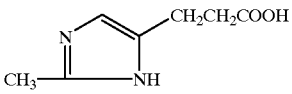

-continued
118
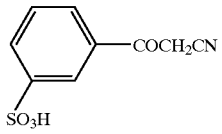
119
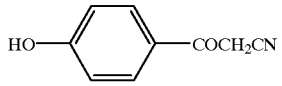
120
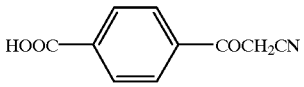
121 $(CH_3)_3CCOCH_2CN$
122
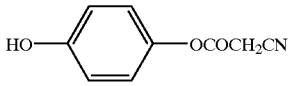
123 $CH_3OCOCH_2CN$
124
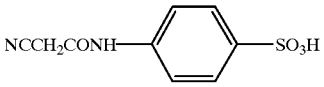
125 $NCCH_2CON(CH_3)_2$
126 $NCCH_2CN$
127
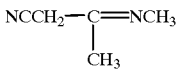
128
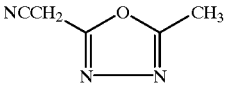
129
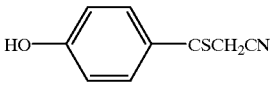
130
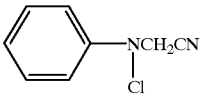
131 $NCCH_2N^+(CH_3)_3Cl^-$
132
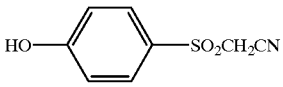
133
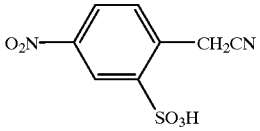
134
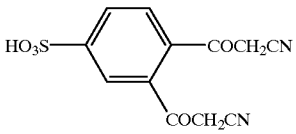

-continued
135 $CH_3COCH_2COCH_2COOH$
136 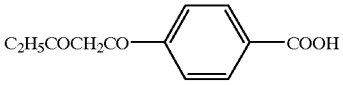
137 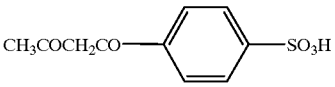
138 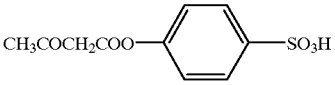
139 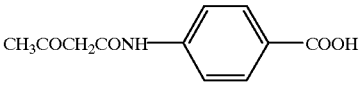
140 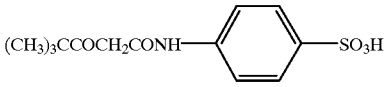
141 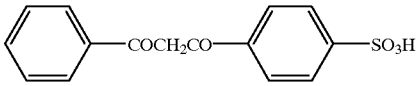
142 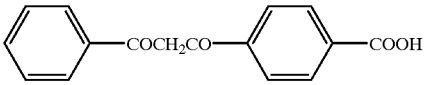
143 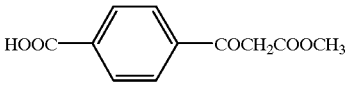
144 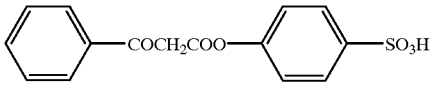
145 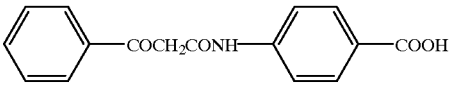
146 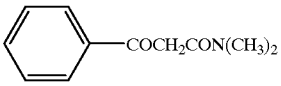
147 $C_2H_5OCOCH_2COOCH_3$
148 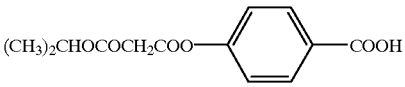
149 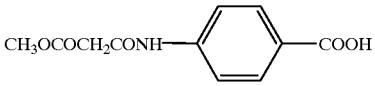

-continued
150
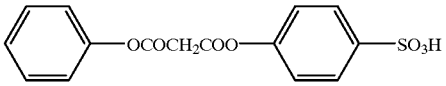
151
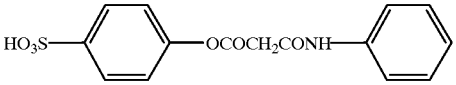
152 $CH_3NHCOCH_2CONHCH_3$
153
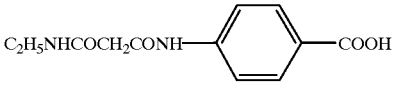
154
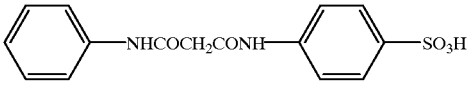
155
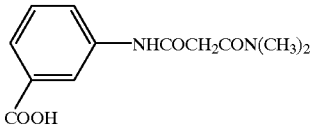
156
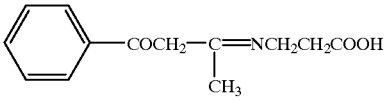
157
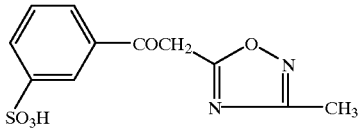
158
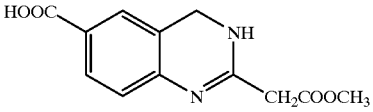
159
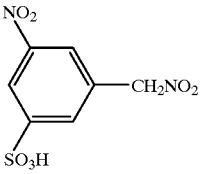
160
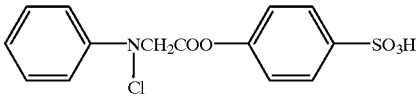
161
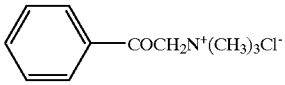
162
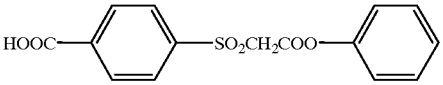

-continued
163
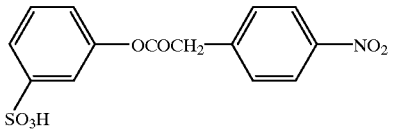
164
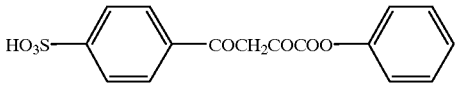
165
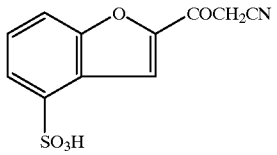
166
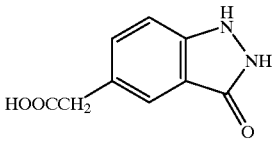
167
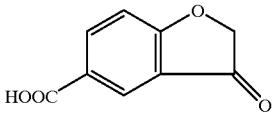
168
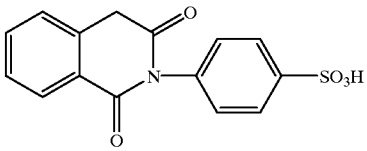
169
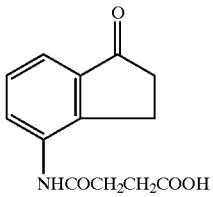
170
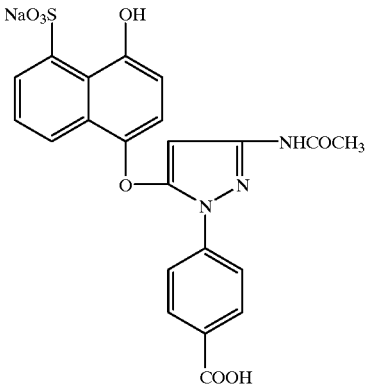
These aqueous soluble couplers are known compounds, some of them are commercially available, and can be readily synthesized according to the methods known in the art, as described in U.S. Pat. Nos. 2,369,929, 2,434,272, and 2,474,293, 2,521,908, JP-A 48-59838 and 51-26034, U.S. Pat. Nos. 2,875,057 and 3,265,506, West German Patent 1,547,868, Published West German Patent Application 2,219,917, U.S. Pat. No. 1,425,020, JP-A 51-10783, U.S. Pat. Nos.

2,600,788 and 2,983,608, West German Patent 1,810,454, West German Patent Application (OLS) 2,408,665, JP-B 40-6031, JP-A 51-20826, J. Chem. Soc., Perkin Trans. I, (1977) 2047-2052, U.S. Pat. No. 3,725,067, JP-A 59-99437, 60-172982 and 60-190779.

The aqueous soluble coupler is contained preferably in an amount of 1 to 150 mmol/l, and more preferably 5 to 100 mmol/l. The aqueous soluble coupler may be used singly or in combination of two or more. The first processing solution or the second processing solution according to the invention may previously contain the aqueous soluble coupler or may contain the aqueous soluble coupler which is leached out of a photographic material during processing, and it is preferred that the first or second processing solution previously contains the aqueous soluble coupler. Further, it is preferred that the aqueous soluble coupler is contained in a processing solution substantially free from a color developing agent. The expression "substantially free from a color developing agent" represents the state in which the color developing agent is not previously added. Therefore, the case of a color developing agent which is contained in the photographic material or which is carried with a processing solution impregnated in the photographic material, is excluded. Furthermore, an embodiment in which the coupler is contained in the second processing solution containing an oxidizing agent, enhances the effect of the invention and is preferable.

A silver halide emulsion used in the invention is preferably any one having a chloride content of not less than 80 mol %, which is comprised of silver bromochloride, silver iodobromochloride, silver iodochloride or silver chloride.

There is also preferably employed a silver halide emulsion comprised of silver halide grains containing a high bromide within the grain. In this case, silver halide grains may be core/shell grains having a layered structure or grain with so-called epitaxial deposition. The halide composition may be varied continuously or discontinuously. A high bromide is preferably localized at the corner of the grain.

Heavy metal ions can be occluded in silver halide emulsion grains for enhancement of various photographic performance. There can be used heavy metal ions of 8 to 10 groups metals such as iron, iridium, platinum, palladium, nickel, rhodium, osmium, ruthenium and cobalt; 12 group transition metals such as cadmium, zinc and mercury; and lead, rhenium, molybdenum, tungsten, gallium, chromium. Of these are preferred ions of metal of iron, iridium, platinum, ruthenium, gallium or osmium. The metal ions can be incorporated in the form of a salt or a complex salt. In cases when the metal ions form a complex, a cyanide ion, thiocyanate ion, isothiocyanate ion, cyanate ion, chloride ion, bromide ion, iodide ion, carbonyl, and ammonium are used as a ligand. Of these are preferred a cyanide ion, thiocyanate ion, isothiocyanate ion, chloride ion and bromide ion.

To allow the heavy metal ions to be occluded within the grain, a compound of the metal can be added at any step before or during formation of silver halide grains, or after grain formation and during physical ripening. It is preferred that the metal compound be dissolved with a halide salt and added continuously over a period of the whole or a part of grain formation. The metal ions is preferably added $1\times10^{-9}$ to $1\times10^{-2}$ mol and more, preferably $1\times10^{-8}$ to $5\times10^{-5}$ mol per mol of silver halide.

Silver halide grains usable in the invention may be any form. One of preferred forms is cubic grains having (100) crystal faces. Silver halide grains in an octahedral, tetradecahedral or dodecahedral form can be prepared according to the method described in U.S. Pat. No. 4,183,756 and 4,225,666, JP-A 55-26589, JP-B 55-42737 (herein the term, "JP-B" means an examined and published Japanese Patent) and J. Photogr. Sci. 21 39 (1973). Further, grains having twin plane(s) can be employed.

Monodisperse silver halide grains having a single form are preferred in the invention. Two or more monodisperse silver halide emulsions can be incorporated into a single layer.

There can be employed a variety of apparatuses and methods for preparing silver halide emulsions, which are generally known in the art. The silver halide can be prepared according to any of acidic precipitation, neutral precipitation and ammoniacal precipitation. Silver halide grains can formed through a single process, or through forming seed grains and growing them. A process for preparing seed grains and a growing process thereof may be the same with or different from each other.

Normal precipitation, reverse precipitation, double jet precipitation or a combination thereof is applicable as a reaction mode of a silver salt and halide salt, and the double jet precipitation is preferred. As one mode of the double jet precipitation is applicable a pAg-controlled double jet method described in JP-A 54-48521. There can be employed a apparatus for supplying a silver salt aqueous solution and a halide aqueous solution through an adding apparatus provided in a reaction mother liquor, as described in JP-A 57-92523 and 57-92524; an apparatus for adding silver salt and halide solutions with continuously varying the concentration thereof, as described in German Patent 2,921,164; and an apparatus for forming grains in which a reaction mother liquor is taken out from the reaction vessel and concentrated by ultra-filtration to keep constant the distance between silver halide grains. Solvents for silver halide such as thioethers are optionally employed. A compound containing a mercapto group, nitrogen containing heterocyclic compound or a compound such as a sensitizing dye can also be added at the time of forming silver halide grains or after completion thereof.

So-called tabular silver halide grains are preferably employed to control the contrast balance. There are known high chloride tabular grains having {111} major faces and those having {100} major faces, and the tabular grain having {100} major faces are preferred in terms of stability of the grain form.

A silver halide emulsion can be chemically sensitized by use of a gold compound or a chalcogen compound. Chalcogen sensitizers applicable to the silver halide emulsion used in the invention include a sulfur sensitizer, a selenium sensitizer and a tellurium sensitizer. Of these is preferred a sulfur sensitizer.

A antifoggant or a stabilizer known in the art are incorporated into the photographic material, for the purpose of preventing fog produced during the process of preparing the photographic material, reducing variation of photographic performance during storage or preventing fog produced in development. Examples of preferred compounds for the purpose include compounds represented by formula (II) described in JP-A 2-146036 at page 7, lower column. These compounds are added in the step of preparing a silver halide emulsion, the chemical sensitization step or the course of from completion of chemical sensitization to preparation of a coating solution.

Photosensitive silver halide contained in the photographic material is preferably in an amount, based on silver, of 0.3 $g/m^2$ or less, and silver halide contained in each photosensitive layer is preferably in an amount, based on silver, of 0.1

$g/m^2$ or less. When the amount of silver halide is within the range described above, the load onto desilvering is small and effects on development of the layer from development concurrently occurred in another layer is also small, resulting in improved stability in tone reproduction. Silver halide contained in each of color image forming layer(s) is in an amount, based on silver, of 0.001 to 0.1 $g/m^2$, and more preferably 0.01 to 0.08 $g/m^2$.

As a dye providing material used in the photographic material relating to the invention are employed couplers, including compounds capable of forming, upon coupling reaction with an oxidized developing agent, a coupling product having an absorption maximum at the wavelengths of 340 nm or larger. Representative examples thereof include a coupler capable of forming an yellow dye having an absorption maximum in a wavelength region of 350 to 500 nm, a coupler capable of forming a magenta dye having an absorption maximum in a wavelength region of 500 to 600 nm and a coupler capable of forming a cyan dye having an absorption maximum in a wavelength region of 350 to 500 nm.

Examples of cyan couplers preferably used in the photographic material include couplers described in JP-A 4-114154, at page 5, left lower column and represented by formulas (C-I) and (C-II); couplers described in JP-A 2-235056, at page 4, left lower column and represented by formulas (Ia), (Ib) and (Ic); couplers described in JP-A 1-224761, at page 6, right lower column to page 7, left upper column and represented by formulas (II α) to (VIII α), and at page 7, lower right column to page 8, left upper column and represented by formulas (II β) to (VIII β). Of these, the couplers represented by formulas (II α) to (VIII α) and (II β) to (VIII β) are preferred in terms of the absorption of the dye being sharp and color reproduction being superior.

Examples of magenta couplers preferably usable in the photographic material employed in the invention include couplers represented by formula (M-I) of (M-II) described in JP-A 4-114154 at page 4, right upper column. Of these couplers are preferred those represented by formula (M-I). A coupler which has a tertiary alkyl group as RM of formula (M-I), is more preferable in terms of being superior in light fastness.

Examples of yellow couplers preferably used in the photographic material employed in the invention include couplers represented by formula (Y-I) described in JP-A 4-114154 at page 3, right upper column. A coupler which has an alkoxy group as RY1 of formula (Y-I), or couplers represented by formula [I] described in JP-A 6-67388 is preferable in terms of preferred reproduction of yellow tone. More preferred compounds are those represented by formula [Y-I] described in JP-A 4-81847 at pages 1 and 11 to 17.

In cases where using an oil-in-water type emulsion-dispersing method to incorporate a coupler or other organic compounds into a photographic material, a coupler is dissolved in a high boiling solvent, optionally in combination with a low boiling and/or water-soluble organic solvent, and further dispersed in a hydrophilic colloid such as a gelatin aqueous solution using a surfactant. The high boiling solvent used for dissolving and dispersing a coupler preferably has a dielectric constant of 3.5 to 7.0. Two or more high boiling solvents can be employed in combination.

As a surfactant used for dispersing a photographic adjuvant or adjusting surface tension at the time of coating are preferably employed compounds having a hydrophobic group with 8 to 30 carbon atoms and a sulfonic acid group or its salt. A surfactant, an alkyl group of which is fluorine-substituted, is also preferably employed. The dispersing solution is conventionally added into a coating solution containing a silver halide emulsion. A period of time until added into the coating solution after dispersing, or until coated after adding into the coating solution is the shorter, is the more preferable. It is preferably within 10 hrs. more preferably 3 hrs. and furthermore preferably 20 min.

The above-described couplers are preferably used in combination with an anti-fading agent to prevent fading of the dye image due to light, heat or humidity. Preferred compounds for magenta dyes include phenyl ether compounds represented by formula I or II described in JP-A 2-66541 at page 3; phenol compounds represented by formula IIIB described in JP-A 3-174150; amine compounds represented by formula A described in JP-A 64-90445; metal complex compounds represented by formula XII, XIII, XIV and XV described in JP-A 62-182741 Compounds represented by formula I' described in JP-A 1-196049 and compounds represented by formula II described in JP-A 5-11417 are preferred for yellow or cyan dyes. A compound (d-11) described in JP-A 4-114154 at page 9, left lower column and a compound (A'-1) described in the same at page 10, left lower column are also employed for allowing the absorption wavelengths of a dye to shift. Besides can also be employed a compound capable of releasing a fluorescent dye described in U.S. Pat. No. 4,774,187.

A compound capable of reacting with an oxidized developing agent is preferably incorporated into a layer between light sensitive layers to prevent color stain or into a silver halide emulsion layer to improve fogging. For the purpose thereof are preferably employed hydroquinone derivatives and more preferably dialkylhydroquinones such as 2,5-di-t-octylhydroquinone.

A UV absorbent is preferably incorporated into the photographic material to prevent static fogging or improve light fastness of dye images. Examples of preferred UV absorbents include benzotriazoles, more preferably, a compound represented by formula III-3 described in JP-A 1-250944, a compound represented by formula III described in JP-A 64-66646, compounds, UV-1L to UV-27L described in JP-A 63-187240, a compound represented by formula I described in JP-A 4-1633 and a compound represented by formula (I) or (II) described in JP-A 5-165144.

There are employed dyes having absorption at various wavelengths for anti-irradiation and anti-halation in the photographic material relating to the invention. A variety of dyes known in the art can be employed, including dyes having absorption in the visible range described in JP-A 3-251840 at page 308, AI-1 to 11, and JP-A 6-3770; infrared absorbing dyes described in JP-A 1-280750 at page 2, left lower column, formula (I), (II) and (III). These dyes do not adversely affect photographic characteristics of a silver halide emulsion and there is no stain due to residual dyes. For the purpose of improving sharpness, the dye is preferably added in an amount that gives a reflection density at 680 nm of not less than 0.7 and more preferably not less than 0.8.

Fluorescent brightening agents are also incorporated into the photographic material to improve whiteness. Examples of preferred compounds include those represented by formula II described in JP-A 2-232652.

The photographic material used in the invention comprises layer(s) containing silver halide emulsion(s) which are spectrally sensitized in the wavelength region of 400 to 900 nm, in combination with a yellow coupler, a magenta coupler and a cyan coupler. The silver halide emulsion contains one or more kinds of sensitizing dyes, singly or in combination thereof. In the silver halide emulsions used in the invention can be employed a variety of spectral-sensitizing dyes known in the art. Compounds BS-1 to 8 described in JP-A 3-251840 at page 28 are preferably employed as a blue-sensitive sensitizing dye. Compounds GS-1 to 5 described in JP-A 3-251840 at page 28 are preferably employed as a green-sensitive sensitizing dye. Compounds RS-1 to 8 described in JP-A 3-251840 at page 29 are preferably employed as a red-sensitive sensitizing dye. In cases where exposed to infra-red ray with a semiconductor laser, infrared-sensitive sensitizing dyes are employed. Compounds IRS-1 to 11 described in JP-A 4-285950 at pages 6-8 are preferably employed as a blue-sensitive sensitizing dye.

Supersensitizers SS-1 to SS-9 described in JP-A 4-285950 at pages 8-9 and compounds S-1 to S-17 described in JP-A 5-66515 at pages 15–17 are preferably included, in combination with these blue-sensitive, green-sensitive and red-sensitive sensitizing dyes.

The sensitizing dye is added at any time during the course of silver halide grain formation to completion of chemical sensitization. The sensitizing dye is incorporated through solution in water-miscible organic solvents such as methanol, ethanol, fluorinated alcohol, acetone and dimethylformamide or water, or in the form of a solid particle dispersion.

In the photographic materials used in the invention is advantageously employed gelatin as a binder. Furthermore, there can be optionally employed other hydrophilic colloidal materials, such as gelatin derivatives, graft polymers of gelatin with other polymers, proteins other than gelatin, saccharide derivatives, cellulose derivatives and synthetic hydrophilic polymeric materials. A vinylsulfone type hardening agent or a chlorotriazine type hardening agent is employed as a hardener of the binder, and compounds described in JP-A 61-249054 and 61-245153 are preferably employed. An antiseptic or antimold described in JP-A 3-157646 is preferably incorporated into a hydrophilic colloid layer to prevent the propagation of bacteria and mold which adversely affect photographic performance and storage stability of images. A lubricant or a matting agent is also preferably incorporated into a protective layer to improve surface physical properties of raw or processed photographic materials, as described in JP-A 6-118543 and 2-73250.

A variety of supports are employed in the photographic material used in the invention, including paper coated with polyethylene or polyethylene terephthalate, paper support made from natural pulp or synthetic pulp, polyvinyl chloride sheet, polypropylene or polyethylene terephthalate supports which may contain a white pigment, and baryta paper. Of these supports a paper support coated, on both sides, with water-proof resin layer. As the water-proof resin are preferably employed polyethylene, ethylene terephthalate and a copolymer thereof. Inorganic and/or organic white pigments are employed, and inorganic white pigments are preferably employed. Supports having a center face roughness (SRa) of 0.15 $\mu$m or less (preferably, 0.12 $\mu$m or less) are preferably employed in terms of glossiness. Trace amounts of a blueing agent or reddening agent such as ultramarine or oil-soluble dyes are incorporated in a water-proof resin layer containing a white pigment or hydrophilic layer(s) of a reflection support to adjust the balance of spectral reflection density in a white portion of processed materials and improve its whiteness. The surface of the support may be optionally subjected to corona discharge, UV light exposure or flame treatment and further thereon, directly or through a sublayer (i.e., one or more sublayer for making improvements in surface properties of the support, such as adhesion property, antistatic property, dimensional stability, friction resistance, hardness, anti halation and/or other characteristics), are coated component layers of the photographic material relating to the invention. In coating of the photographic material, a thickening agent may be employed to enhance coatability of a coating solution. As a coating method are useful extrusion coating and curtain coating, in which two or more layers are simultaneously coated.

To form photographic images using a photographic material relating to the invention, an image recorded on the negative can optically be formed on a photographic material to be printed. Alternatively, the image is converted to digital information to form the image on a CRT (cathode ray tube), and the resulting image can be formed on a photographic material to be printed by projecting or scanning with varying the intensity and/or exposing time of laser light, based on the digital information.

The image forming method according to the invention is preferably applied to photographic materials used for forming a directly observable image, including a color print paper, color reversal paper. direct positive material, display photographic material and a photographic material used for color proof. Specifically, the image forming method is preferably applied to photographic materials having a reflection support.

In the image forming method according to the invention, photographic materials, after color-developed, may be optionally subjected to bleaching and fixing. The bleaching and fixing may be carried out currently. After fixing, washing is conventionally carried out. Stabilizing may be conducted in place of washing. As a processing apparatus used in the invention is applicable a roller transport type processor in which a photographic material is transported with being nipped by rollers and an endless belt type processor in which a photographic material is transported with being fixed in a belt. Further thereto are also employed a method in which a processing solution supplied to a slit-formed processing bath and a photographic material is transported there through, a spraying method, a web processing method by contact with a carrier impregnated with a processing solution and a method by use of viscous processing solution.

EXAMPLES

The present invention will be further explained based on examples, but embodiments of the invention are not limited to these.

Example 1

Preparation of blue-sensitive silver halide emulsion (Em-B1):

To 1 liter of aqueous 2% gelatin solution kept at 40° C. were simultaneously added the following solutions (Solutions A1 and B1) while being maintained at a pAg of 7.3 and pH of 3.0, and further thereto were added Solutions Cl and D1, while being maintained at a pAg of 8.0 and pH of 5.5. The pAg was controlled by the method described in JP-A 59-45437, and the pH was adjusted using aqueous sulfuric acid or sodium hydroxide solution.

| | |
|---|---|
| Solution A1 | |
| Sodium chloride | 3.42 g |
| Potassium bromide | 0.03 g |
| Water to make | 200 ml |
| Solution B1 | |
| Silver nitrate | 10 g |
| Water to make | 200 ml |

-continued

| | |
|---|---|
| Solution C1 | |
| Sodium chloride | 102.7 g |
| Potassium hexachloroiridium (IV) | $4 \times 10^{-8}$ mol |
| Potassium hexacyano-iron (II) | $2 \times 10^{-5}$ mol |
| Potassium bromide | 1.0 g |
| Water to make | 600 ml |
| Solution D1 | |
| Silver nitrate | 300 g |
| Water to make | 600 ml |

After completing the addition, the resulting emulsion was desalted using a 5% aqueous solution of Demol N (produced by Kao-Atlas) and aqueous 20% magnesium sulfate solution, and redispersed in a gelatin aqueous solution to obtain a monodisperse cubic grain emulsion (EMP-1A) having an average grain size of 0.57 μm, a coefficient of variation of grain size of 0.07 and a chloride content of 99.5 mol %.

The emulsion, EMP-1A was chemically sensitized at 60° C. using the following compounds.

| | |
|---|---|
| Sodium thiosulfate | 0.8 mg/mol AgX |
| Chloroauric acid | 0.5 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of green-sensitive silver halide emulsion (Em-G1)

Monodisperse cubic grain emulsions, EMP-11A having an average grain size of 0.30 μm and a chloride content of 99.5 mol % was prepared in the same manner as in preparation of EMP-1A, except that an adding time of Solutions A1 and B1, and that of C1 and D1 were respectively varied.

The emulsion, EMP-11A was optimally chemical-sensitized at 60° C. using the following compounds to obtain a green-sensitive silver halide emulsion (Em-G1).

| | |
|---|---|
| Sodium thiosulfate | 1.5 mg/mol AgX |
| Chloroauric acid | 1.0 mg/mol AgX |
| Sensitizing dye GS-1 | $4 \times 10^{-4}$ mol/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |

Preparation of red-sensitive silver halide emulsion (Em-R1)

Monodisperse cubic grain emulsions, EMP-21A having an average grain size of 0.32 μm and a chloride content of 99.5 mol % was prepared in the same manner as in preparation of EMP-1A, except that an adding time of Solutions A1 and B1, and that of C1 and D1 were respectively varied.

The emulsion, EMP-21A was optimally chemical-sensitized at 60° C. using the following compounds to obtain a red-sensitive silver halide emulsion (Em-R1).

| | |
|---|---|
| Sodium thiosulfate | 1.8 mg/mol AgX |
| Chloroauric acid | 2.0 mg/mol AgX |
| Sensitizing dye RS-1 | $1 \times 10^{-4}$ mol/mol AgX |
| Sensitizing dye RS-2 | $1 \times 10^{-4}$ mol/mol AgX |
| SS-1 | $2 \times 10^{-3}$ mol/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |

Additives used in emulsions Em-B1, Em-G1 and Em-R1 were as follows

STAB-1: 1-(3-Acetoamidophenyl)-5-mercaptotetrazole
STAB-2: 1-Phenyl-5-mercaptotetrazole
STAB-3: 1-(4-ethoxyphenyl)-5-mercaptotetrazole

BS-1

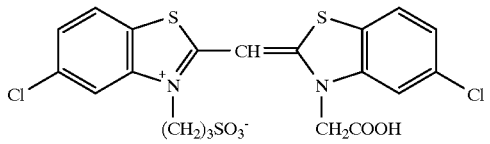

BS-2

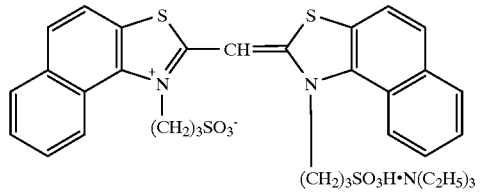

GS-1

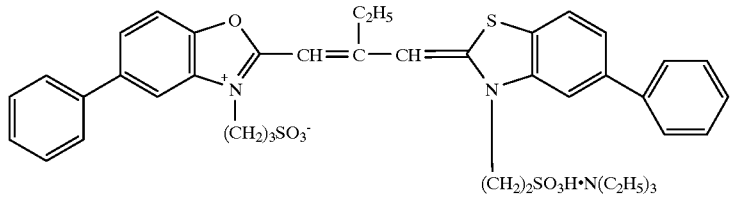

-continued

RS-1

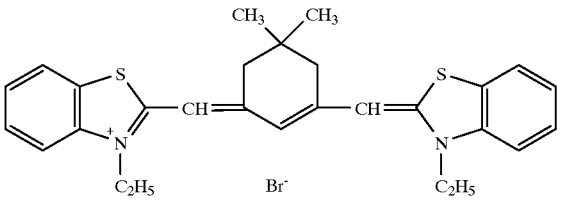

RS-2

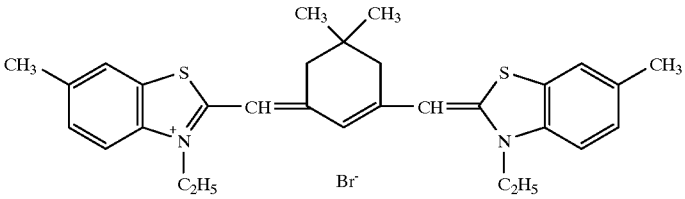

SS-1

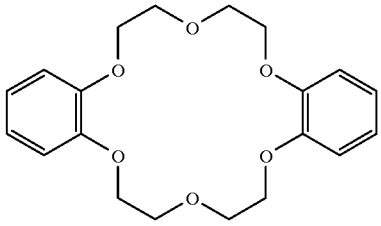

Preparation of silver halide photographic material (101)

There was prepared a paper support laminated, on paper with a weight of 180 g/m$^2$, with high density polyethylene, provided that the side to coat an emulsion layer was laminated with polyethylene melt containing surface-treated anatase type titanium oxide in an amount of 15% by weight. The reflection support was subjected to corona discharge and provided with a gelatin sublayer, and further thereon, the following component layers were provided to prepare a silver halide photographic material. Coating solutions each were prepared so as to have coating amounts as below. Hardeners (H-1) and (H-2) were added. There were also added surfactants, (SU-2) and (SU-3) to adjust surface tension. To each layer was further added (F-1) in an amount of 0.04 g/m$^2$. The coating amount was silver halide was based on silver.

| Layer | Constitution | Amount (g/m$^2$) |
|---|---|---|
| 7th layer | Gelatin | 1.00 |
| (Protective layer) | High boiling solvent (DIDP) | 0.002 |
| | High boiling solvent (DBP) | 0.002 |
| | Silicon dioxide | 0.003 |
| 6th layer | Gelatin | 0.40 |
| (UV absorbing layer) | AI-1 | 0.01 |
| | UV absorbent (UV-1) | 0.12 |
| | UV absorbent (UV-2) | 0.04 |
| | UV absorbent (UV-3) | 0.16 |
| | Antistaining agent (HQ-5) | 0.04 |
| | PVP (polyvinyl pyrrolidone) | 0.03 |
| 5th layer | Gelatin | 1.30 |
| (Red-sensitive layer) | Red-sensitive emulsion (Em-R1) | 0.020 |
| | Cyan coupler (C-1) | 0.28 |
| | Dye image stabilizer (ST-1) | 0.10 |
| | Antistaining agent (HQ-1) | 0.004 |
| | High boiling solvent (DBP) | 0.10 |
| | High boiling solvent (DOP) | 0.20 |
| 4th layer | Gelatin | 0.94 |

-continued

| Layer | Constitution | Amount (g/m$^2$) |
|---|---|---|
| (UV absorbing layer) | UV absorbent (UV-1) | 0.28 |
| | UV absorbent (UV-2) | 0.09 |
| | UV absorbent (UV-3) | 0.38 |
| | AI-1 | 0.02 |
| | Antistaining agent (HQ-5) | 0.10 |
| 3rd layer | Gelatin layer | 1.30 |
| (Green-sensitive layer) | AI-2 | 0.01 |
| | Green-sensitive emulsion (Em-G1) | 0.025 |
| | Magenta coupler (M-1) | 0.20 |
| | Dye image stabilizer (ST-3) | 0.20 |
| | Dye image stabilizer (ST-4) | 0.17 |
| | High boiling solvent (DIDP) | 0.13 |
| | High boiling solvent (DBP) | 0.13 |
| 2nd layer | Gelatin | 1.20 |
| (Interlayer) | AI-3 | 0.01 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | High boiling solvent (DIDP) | 0.04 |
| | High boiling solvent (DBP) | 0.02 |
| | Brightening agent (W-1) | 0.10 |
| 1st layer | Gelatin | 1.20 |
| (Blue-sensitive layer) | Blue-sensitive Emulsion (Em-B1) | 0.062 |
| | Yellow coupler (Y-1) | 0.70 |
| | Dye image stabilizer (ST-1) | 0.10 |
| | Dye image stabilizer (ST-2) | 0.10 |
| | Dye image stabilizer (ST-5) | 0.10 |
| | Antistaining agent (HQ-1) | 0.01 |
| | Image stabilizer A | 0.15 |
| | High boiling solvent (DBP) | 0.10 |
| | High boiling solvent (DNP) | 0.05 |
| Support | polyethylene-laminated paper (containing a small amount of a bluing dye) | |

SU-1: Sodium tri-i-propylnaphthalenesulfonate

SU-2: Di(2-ethylhexyl) sulfosuccinate sodium salt

SU-3: 2,2,3,3,4,4,5,5-Octafluoropentyl sulfosuccinate sodium salt
H-1: Tetrakis(vinylsulfonylmethyl)methane
H-2: 2,4-Dichloro-6-hydroxy-s-triazine sodium salt
DBP: Dibutyl phthalate
DIDP: Diisodecyl phthalate
DOP: Dioctyl phthalate
DNP: Dinonyl phthalate
PVP: Polyvinyl pyrrolidone
HQ-1: 2,5-Di-t-octylhydroquinone
HQ-2: 2,5-Di-sec-dodecylhydroquinone
HQ-3: 2,5-Di-sec-tetradecylhydroquinone
HQ-4: 2-sec-Dodecyl-5-sec-tetradecylhydroquinone
HQ-5: 2,5-Di(1,1-dimethyl-4-hexyloxycarbonyl)butylhydroquinone
Image stabilizer A: p-t-Octylphenol

Y-1

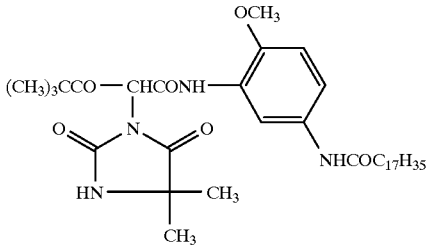

M-1

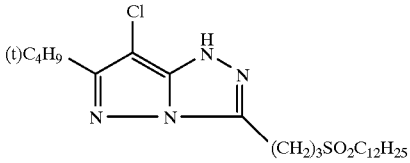

C-1

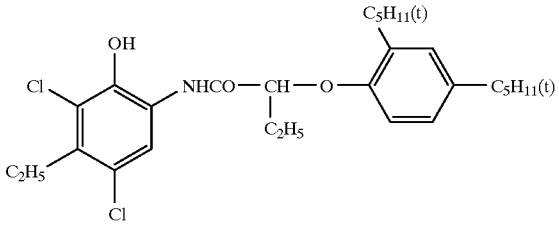

ST-1

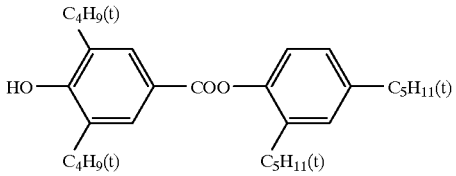

ST-2

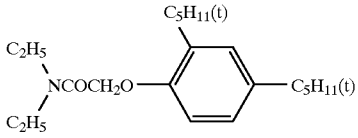

ST-3

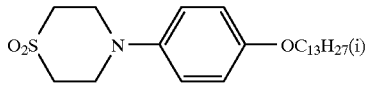

ST-4

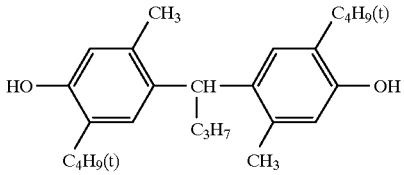

-continued
ST-5
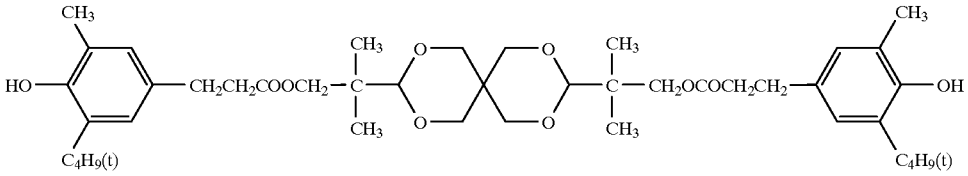
UV-1
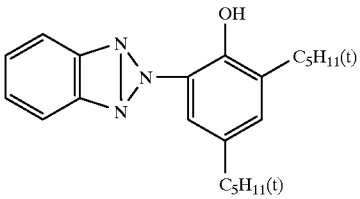
UV-2
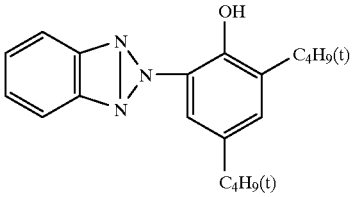
UV-3
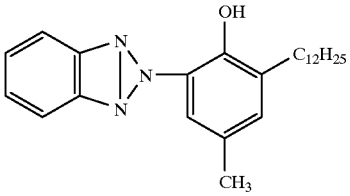
W-1
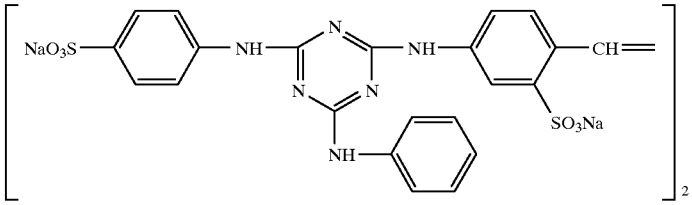
Al-1
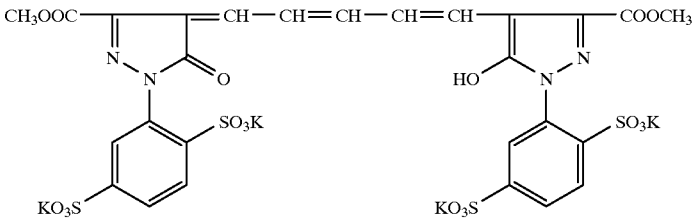
Al-2
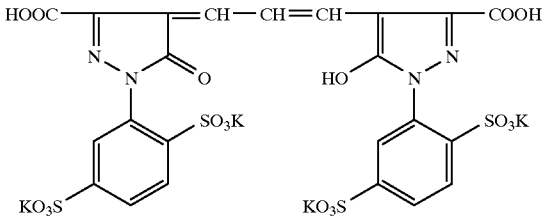

-continued

Al-3

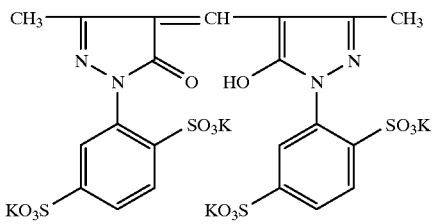

F-1

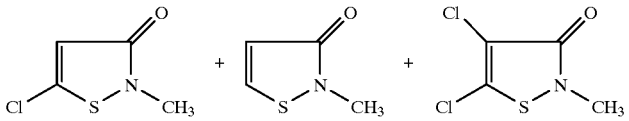

(50%) (46%) (4%)

mixture in above molar ratio

Photographic material sample (101) was exposed to white light for 0.5 sec. and then processed, using a first processing solution (CD-1) and a second processing solution (OX-1) and according to the amplification development processes 101 to 120 as shown in Table 1, followed by a desilvering process. The temperature of the first and second processing solution was 36° C. Between processing steps, extraneous processing solution on the surface of the photographic material was removed with a silicone rubber blade.

Processed photographic material samples were subjected to sensitometry using a densitometer PDA-65 (produced by Konica Corp.) to measure reflection densities with blue, green or red light to determine the minimum density (Dmin) and the maximum density (Dmax).

20 sheets of exposed photographic material sample 101 were prepared and subjected to processing and sensitometry in a manner similar to that described above. In the first sheet sample, an optical wedge step having a green light relection density closest to 0.75 was selected, green light reflection densities at the same step for each of 20 sheet samples were measured and evaluated with respect to fluctuations of the densities (intermediate density). In each processing, even when processed in a short time, an image forming method giving a high maximum density is preferable and an image forming method with a smaller fluctuation in destiny are also preferable with respect to process stability.

Results thereof are shown in Table 1. In the Table, the maximum and minimum densities measured with blue, green or red light were each denoted in terms of "B", "G" and "R", respectively.

Compositions of processing solutions are as follows. Composition of processing solutions is as follows.

First processing solution (CD-1)

| | |
|---|---|
| Water | 800 ml |
| Potassium bromide | 0.001 g |
| Potassium chloride | 0.35 g |
| N-Ethyl-N-(β-methanesulfonamidoethyl) -3-methyl-4-aminoaniline sulfate | 10.0 g |
| Black-and-white developing agent as shown in Table 1 | |

The pH was adjusted to 7.0 with potassium hydroxide or sulfuric acid, and water was added to make the total volume 1 liter.

Second processing solution (OX-1)

| | |
|---|---|
| Water | 800 ml |
| Disodium hydrogenphosphate | 10 g |
| Potassium carbonate | 20 g |
| Sodium diethylenetriaminepentaacetate | 2.0 g |
| 1-Hydroxyethylidene-1,1'-disulfonic acid | 0.35 g |
| Hydrogen peroxide | 0.08 mole |

Water was added to make 1 liter and the pH was adjusted to 11.0 with sulfuric acid or potassium hydroxide.

Desilvering process:

| Step | time | Temperature |
|---|---|---|
| Bleach-fixing | 20 sec. | 30.0 ± 0.5° C. |
| Stabilizing | 60 sec. | 30 to 34° C. |
| Drying | 30 sec. | 60 to 80° C. |

Bleach-fixing solution (BF-1)

| | |
|---|---|
| Water | 700 ml |
| Ammonium ferric diethylenetriaminepenta-acetate dihydride | 65 g |
| Diethylenetriaminepentaacetic acid | 3 g |
| Ammonium thiosulfate (70% aq. solution) | 100 ml |
| 2-Amino-5-mercapto-1,3,4-thiadiazole | 2.0 g |
| Ammonium sulfite (40% aq. solution) | 27.5 ml |

Water was added to make 1 liter and the pH was adjusted to 5.0 with potassium carbonate or glacial acetic acid.

Stabilizing solution

| | |
|---|---|
| Water | 800 ml |
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| Bismuth chloride (45% aq. solution) | 0.65 g |
| Magnesium sulfate heptahydride | 0.2 g |
| PVP (polyvinyl pyrrolidone) | 1.0 g |

-continued

| | |
|---|---|
| Ammonia water (25% ammonium hydroxide aqueous solution) | 2.5 g |
| Trisodium nitrilotriacetate | 1.5 g |

Water was added to make 1 liter and the pH was adjusted to 7.5 with sulfuric acid or ammonia water.

TABLE 1

| Amplification Process | 1st proc. soln. B&W dev. agent Kind | mol/l | Dev. ratio* | Proc. time (sec) | 2nd. proc. soln. Proc. time (sec) | Maximum density D-min R | G | B | Minimum density (Dmax) R | G | B | Density fluctuation |
|---|---|---|---|---|---|---|---|---|---|---|---|---|
| 101(Comp.) | — | — | 0.00 | 15 | 25 | 2.21 | 2.08 | 1.78 | 0.05 | 0.03 | 0.09 | ±0.06 |
| 102(Comp.) | — | — | 0.00 | 25 | 25 | 2.25 | 2.13 | 1.98 | 0.06 | 0.03 | 0.11 | ±0.07 |
| 103(Inv.) | BW-1** | 0.005 | 0.21 | 15 | 25 | 2.24 | 2.16 | 2.08 | 0.04 | 0.03 | 0.06 | ±0.03 |
| 104(Inv.) | BW-1 | 0.005 | 0.21 | 25 | 25 | 2.28 | 2.17 | 2.11 | 0.05 | 0.03 | 0.07 | ±0.03 |
| 105(Inv.) | BW-2 | 0.005 | 0.21 | 15 | 25 | 2.24 | 2.16 | 2.09 | 0.04 | 0.03 | 0.06 | ±0.02 |
| 106(Inv.) | BW-2 | 0.005 | 0.21 | 25 | 25 | 2.28 | 2.18 | 2.10 | 0.05 | 0.03 | 0.07 | ±0.03 |
| 107(Inv.) | A-17 | 0.0003 | 0.01 | 15 | 25 | 2.25 | 2.16 | 2.09 | 0.04 | 0.03 | 0.06 | ±0.03 |
| 108(Inv.) | A-17 | 0.0003 | 0.01 | 25 | 25 | 2.28 | 2.18 | 2.11 | 0.05 | 0.03 | 0.07 | ±0.03 |
| 109(Inv.) | A-17 | 0.001 | 0.04 | 15 | 25 | 2.27 | 2.18 | 2.12 | 0.04 | 0.03 | 0.05 | ±0.01 |
| 110(Inv.) | A-17 | 0.001 | 0.04 | 25 | 25 | 2.28 | 2.19 | 2.12 | 0.04 | 0.03 | 0.06 | ±0.01 |
| 111(Inv.) | A-17 | 0.005 | 0.21 | 15 | 25 | 2.28 | 2.18 | 2.11 | 0.04 | 0.02 | 0.05 | ±0.01 |
| 112(Inv.) | A-17 | 0.005 | 0.21 | 25 | 25 | 2.28 | 2.18 | 2.12 | 0.04 | 0.03 | 0.05 | ±0.01 |
| 113(Inv.) | A-17 | 0.01 | 0.42 | 15 | 25 | 2.27 | 2.18 | 2.12 | 0.04 | 0.02 | 0.06 | ±0.01 |
| 114(Inv.) | A-17 | 0.01 | 0.42 | 25 | 25 | 2.28 | 2.18 | 2.12 | 0.04 | 0.02 | 0.06 | ±0.01 |
| 115(Inv.) | A-17 | 0.05 | 2.09 | 15 | 25 | 2.24 | 2.16 | 2.08 | 0.04 | 0.03 | 0.05 | ±0.03 |
| 116(Inv.) | A-17 | 0.05 | 2.09 | 25 | 25 | 2.28 | 2.17 | 2.11 | 0.05 | D.03 | 0.06 | ±0.03 |
| 117(Inv.) | A-16 | 0.005 | 0.21 | 15 | 25 | 2.27 | 2.18 | 2.12 | 0.04 | 0.02 | 0.05 | ±0.91 |
| 118(Inv.) | A-16 | 0.005 | 0.21 | 25 | 25 | 2.28 | 2.18 | 2.12 | 0.04 | 0.03 | 0.06 | ±0.01 |
| 119(Inv.) | A-19 | 0.005 | 0.21 | 15 | 25 | 2.27 | 2.18 | 2.12 | 0.04 | 0.03 | 0.05 | ±0.01 |
| 120(Inv.) | A-19 | 0.005 | 0.21 | 25 | 25 | 2.28 | 2.19 | 2.12 | 0.04 | 0.03 | 0.05 | ±0.01 |

*Malar ratio of black-and-white developing agent to color developing agent
**BW-1: Phenidone (1-phenyl-3-pyrazolidone)
BW-2* Dimezone S (1-phenyl-4-methyl-4hydroxymethyl-3-pyrazolidone)

As can be seen from Table 1, amplification processes 103 to 120, each of which contains both black-and-white developing agent and color developing agent, exhibited a lower minimum density and higher maximum density even when the processing time was shortened, and little fluctuations in density when subjected to continuous processing, as compared to amplification process 101 and 102 which contain no black-and-white developing agent. Further, from the results of processes 103 to 106, 112, 113, 117 to 120, the use of a black-and-white developing agent represented by formula (A) led to a lower minimum density of the yellow image forming layer and less fluctuation in density on continuous processing. Furthermore, from the comparison of processes 107 to 116, processes 109 to 114, which fell within the preferred range regarding the ratio of black-and-white developing agent to color developing agent, exhibited marked effects of the invention.

Example 2

Photographic material sample (101) prepared in Example 1 was exposed to white light for 0.5 sec. and subjected to amplification development, followed by desilvering process in a manner similar to Example 1, except that the following first processing solution (CD-2) and second processing solution (OX-2) were employed, and the amplification development process was varied to any one of processes 201 to 220 as shown in Table 2.

Processed samples were measured and evaluated in the same manner as in Example 1, and results thereof are shown in Table 2.

| First processing solution (CD-2) | |
|---|---|
| Water | 800 ml |
| Potassium bromide | 0.001 g |
| Potassium chloride | 0.35 g |
| N-Ethyl-N-(β-methanesulfonamidoethyl) -3-methyl-4-aminoaniline sulfate | 10.0 g |
| Black-and-white developing agent (A-17) | 0.005 mole |

The pH was adjusted to a value as shown in Table 2 with potassium hydroxide or sulfuric acid, and water was added to make the total volume 1 liter.

| Second processing solution (OX-2) | |
|---|---|
| Water | 800 ml |
| Disodium hydrogenphosphate | 10 g |
| Potassium carbonate | 20 g |
| Sodium diethylenetriaminepentaacetate | 2.0 g |
| 1-Hydroxyethylidene-1,1'-disulfonic acid | 0.35 g |
| Hydrogen peroxide | 0.08 mole |

Water was added to make 1 liter and the pH was adjusted to a value as shown in Table 2, with sulfuric acid or potassium hydroxide.

TABLE 2

| Amplification Process | 1st proc. soln pH | 1st proc. soln Proc. time (sec) | 2nd. proc. soln. pH | 2nd. proc. soln. Proc. time (sec) | pH-difference | Maximum density D-min R | Maximum density D-min G | Maximum density D-min B | Minimum density (Dmax) R | Minimum density (Dmax) G | Minimum density (Dmax) B | Density fluctuation |
|---|---|---|---|---|---|---|---|---|---|---|---|---|
| 204(Inv.) | 5.9 | 15 | 10 | 25 | 4.1 | 2.23 | 2.15 | 2.08 | 0.03 | 0.03 | 0.05 | ±0.03 |
| 202(Inv.) | 5.9 | 25 | 10 | 25 | 4.1 | 2.27 | 2.17 | 2.11 | 0.04 | 0.03 | 0.06 | ±0.03 |
| 203(Inv.) | 6.9 | 15 | 10 | 25 | 3.1 | 2.28 | 2.17 | 2.11 | 0.04 | 0.02 | 0.05 | ±0.01 |
| 204(Inv.) | 6.9 | 25 | 10 | 25 | 3.1 | 2.28 | 2.18 | 2.12 | 0.04 | 0.03 | 0.05 | ±0.02 |
| 205(Inv.) | 7.9 | 15 | 10 | 25 | 2.1 | 2.28 | 2.18 | 2.11 | 0.04 | 0.02 | 0.05 | ±0.01 |
| 206(Inv.) | 7.9 | 25 | 10 | 25 | 2.1 | 2.28 | 2.18 | 2.1 | 0.04 | 0.03 | 0.05 | ±0.01 |
| 207(Inv.) | 8.9 | 15 | 10 | 25 | 1.1 | 2.28 | 2.18 | 2.11 | 0.04 | 0.02 | 0.05 | ±0.02 |
| 208(Inv.) | 8.9 | 25 | 10 | 25 | 1.1 | 2.28 | 2.18 | 2.12 | 0.04 | 0.03 | 0.05 | ±0.02 |
| 209(Comp.) | 8.9 | 15 | 9 | 25 | 0.1 | 2.16 | 2.04 | 1.76 | 0.05 | 0.03 | 0.06 | ±0.06 |
| 210(Comp.) | 8.9 | 25 | 9 | 25 | 0.1 | 2.18 | 2.06 | 1.89 | 0.06 | 0.03 | 0.07 | ±0.07 |
| 211(Inv.) | 8.9 | 15 | 10 | 25 | 1.1 | 2.28 | 2.18 | 2.11 | 0.04 | 0.02 | 0.05 | ±0.01 |
| 212(Inv.) | 8.9 | 25 | 10 | 25 | 1.1 | 2.28 | 2.18 | 2.12 | 0.04 | 0.03 | 0.05 | ±0.01 |
| 213(Inv.) | 8.9 | 15 | 11 | 25 | 2.1 | 2.28 | 2.18 | 2.11 | 0.04 | 0.02 | 0.05 | ±0.01 |
| 214(Inv.) | 8.9 | 25 | 11 | 25 | 2.1 | 2.28 | 2.18 | 2.12 | 0.04 | 0.03 | 0.05 | ±0.01 |
| 215(Inv.) | 9.9 | 15 | 10 | 25 | 0.1 | 2.21 | 2.09 | 1.79 | 0.05 | 0.03 | 0.09 | ±0.06 |
| 216(Inv.) | 9.9 | 25 | 10 | 25 | 0.1 | 2.25 | 2.12 | 1.99 | 0.06 | 0.03 | 0.1 | ±0.07 |
| 217(Inv.) | 10.9 | 15 | 10 | 25 | −0.9 | 2.21 | 2.08 | 1.8 | 0.05 | 0.03 | 0.09 | ±0.06 |
| 218(Inv.) | 10.9 | 25 | 10 | 25 | −0.9 | 2.24 | 2.11 | 2.1 | 0.06 | 0.03 | 0.11 | ±0.06 |
| 219(Inv.) | 10.9 | 15 | 11.5 | 25 | 0.6 | 2.23 | 2.16 | 2.09 | 0.04 | 0.03 | 0.05 | ±0.03 |
| 220(Inv.) | 10.9 | 25 | 11.5 | 25 | 0.6 | 2.27 | 2.17 | 2.12 | 0.05 | 0.03 | 0.05 | ±0.03 |

As can be seen from Table 2, when the pH of the first processing solution was at least 0.5 lower than that of the second processing solution, less fluctuations in density as well as a higher maximum density and lower minimum density were preferably achieved. Particularly, processes 203 to 208 and 211 to 214 exhibited marked effects of the invention.

Example 3

Photographic material sample (101) prepared in Example 1 was exposed to white light for 0.5 sec. and subjected to amplification development, followed by desilvering process in a manner similar to Example 1, except that the following first processing solution (CD-3) and second processing solution (OX-3) were employed, and the amplification development process was varied to any one of processes 301 to 320 as shown in Table 3.

Processed samples were measured and evaluated in the same manner as in Example 1, and the results thereof are shown in Table 3.

| First processing solution (CD-3) | |
|---|---|
| Water | 800 ml |
| Potassium bromide | 0.001 g |

-continued

| First processing solution (CD-3) | |
|---|---|
| Potassium chloride | 0.35 g |
| N-Ethyl-N-(β-methanesulfonamidoethyl) -3-methyl-4-aminoaniline sulfate | 10.0 g |
| Black-and-white developing agent (A-17) | 0.005 mole |

The pH was adjusted to 7.0 with potassium hydroxide or sulfuric acid, and water was added to make the total volume 1 liter.

| Second processing solution (OX-3) | |
|---|---|
| Water | 800 ml |
| Disodium hydrogenphosphate | 10 g |
| Potassium carbonate | 20 g |
| Sodium diethylenetriaminepentaacetate | 2.0 g |
| 1-Hydroxyethylidene-1,1'-disulfonic acid | 0.35 g |
| Hydrogen peroxide | 0.08 mole |

Water was added to make 1 liter and the pH was adjusted to 11.0 with sulfuric acid or potassium hydroxide.

TABLE 3

| Amplification Process | 1st proc. soln Temp. (°C.) | 1st proc. soln Proc. time (sec) | 2nd. proc. soln. Temp. (°C.) | 2nd. proc. soln. Proc. time (sec) | Temp.-difference | Maximum density D-min R | Maximum density D-min G | Maximum density D-min B | Minimum density (Dmax) R | Minimum density (Dmax) G | Minimum density (Dmax) B | Density fluctuation |
|---|---|---|---|---|---|---|---|---|---|---|---|---|
| 301(Inv.) | 28 | 15 | 33 | 25 | −5 | 2.22 | 2.15 | 2.07 | 0.04 | 0.03 | 0.05 | ±0.03 |
| 302(Inv.) | 28 | 25 | 33 | 25 | −5 | 2.26 | 2.18 | 2.11 | 0.04 | 0.03 | 0.06 | ±0.03 |
| 303(Inv.) | 33 | 15 | 33 | 25 | 0 | 2.22 | 2.14 | 2.06 | 0.04 | 0.03 | 0.05 | ±0.03 |

TABLE 3-continued

| Amplification Process | 1st proc. soln Temp. (°C.) | 1st proc. soln Proc. time (sec) | 2nd. proc. soln. Temp. (°C.) | 2nd. proc. soln. Proc. time (sec) | Temp.-difference | Maximum density D-min R | G | B | Minimum density (Dmax) R | G | B | Density fluctuation |
|---|---|---|---|---|---|---|---|---|---|---|---|---|
| 304(Inv.) | 33 | 25 | 33 | 25 | 0 | 2.26 | 2.18 | 2.12 | 0.04 | 0.03 | 0.06 | ±0.03 |
| 305(Inv.) | 39 | 15 | 33 | 25 | 6 | 2.22 | 2.15 | 2.06 | 0.04 | 0.03 | 0.05 | ±0.03 |
| 306(Inv.) | 39 | 25 | 33 | 25 | 6 | 2.26 | 2.18 | 2.11 | 0.04 | 0.03 | 0.06 | ±0.03 |
| 307(Inv.) | 44 | 15 | 33 | 25 | 11 | 2.24 | 2.16 | 2.09 | 0.04 | 0.03 | 0.06 | ±0.06 |
| 308(Inv.) | 44 | 25 | 33 | 25 | 11 | 2.26 | 2.18 | 2.11 | 0.04 | 0.03 | 0.07 | ±0.07 |
| 309(Inv.) | 28 | 15 | 36 | 25 | −8 | 2.26 | 2.17 | 2.1 | 0.04 | 0.03 | 0.06 | ±0.02 |
| 310(Inv.) | 28 | 25 | 36 | 25 | −8 | 2.27 | 2.18 | 2.11 | 0.04 | 0.03 | 0.07 | ±0.02 |
| 311(Inv.) | 33 | 15 | 36 | 25 | −3 | 2.26 | 2.17 | 2.1 | 0.04 | 0.03 | 0.06 | ±0.02 |
| 312(Inv.) | 33 | 25 | 36 | 25 | −3 | 2.27 | 2.18 | 2.11 | 0.04 | 0.03 | 0.07 | ±0.02 |
| 313(Inv.) | 39 | 15 | 36 | 25 | 3 | 2.26 | 2.17 | 2.1 | 0.04 | 0.03 | 0.06 | ±0.02 |
| 314(Inv.) | 39 | 25 | 36 | 25 | 3 | 2.27 | 2.18 | 2.11 | 0.04 | 0.03 | 0.07 | ±0.02 |
| 315(Inv.) | 44 | 15 | 36 | 25 | 8 | 2.28 | 2.18 | 2.11 | 0.04 | 0.02 | 0.06 | ±0.02 |
| 316(Inv.) | 44 | 25 | 36 | 25 | 8 | 2.28 | 2.18 | 2.12 | 0.04 | 0.03 | 0.07 | ±0.02 |
| 317(Inv.) | 47 | 15 | 36 | 25 | 11 | 2.28 | 2.18 | 2.11 | 0.04 | 0.02 | 0.1 | ±0.06 |
| 318(Inv.) | 47 | 25 | 36 | 25 | 11 | 2.28 | 2.18 | 2.12 | 0.04 | 0.03 | 0.14 | ±0.06 |
| 319(Inv.) | 38 | 15 | 40 | 25 | −2 | 2.28 | 2.18 | 2.11 | 0.04 | 0.02 | 0.06 | ±0.02 |
| 320(Inv.) | 38 | 25 | 40 | 25 | −2 | 2.28 | 2.18 | 2.12 | 0.04 | 0.03 | 0.07 | ±0.02 |

As can be seen from Table 3, when the temperature of the first processing solution ($T_1$) and that of the second processing solution ($T_2$) meet the relation, $T_1-T_2<10$, less fluctuations in density as well as a higher maximum density and lower minimum density were preferably achieved. Particularly, processes 309 to 316, 319 and 320, in which the temperature of the second processing solution was higher than 35° C., exhibited a higher maximum density even when the processing time was shortened and displayed marked effects of the invention.

Example 4

Photographic material sample (101) prepared in Example 1 was exposed to white light for 0.5 sec. and subjected to amplification development, followed by desilvering process in a manner similar to Example 1, except that the following first processing solution (CD-4) and second processing solution (OX-4) were employed, and the amplification development process was varied to any one of processes 401 to 420 as shown in Table 4.

Processed samples were measured and evaluated in the same manner as in Example 1, and results thereof are shown in Table 4.

| First processing solution (CD-4) | |
|---|---|
| Water | 800 ml |
| Potassium bromide | 0.001 g |
| Potassium chloride | 0.35 g |
| N-Ethyl-N-(β-methanesulfonamidoethyl) -3-methyl-4-aminoaniline sulfate | 10.0 g |
| Black-and-white developing agent (A-17) | 0.005 mole |
| Sodium metaborate | amount shown in Table 4 |

The pH was adjusted to a value as shown in Table 4 with potassium hydroxide or sulfuric acid, and water was added to make the total volume 1 liter.

| Second processing Solution (OX-4) | |
|---|---|
| Water | 800 ml |
| Potassium carbonate | amount shown in Table 4 |
| Sodium diethylenetriaminepentaacetate | 2.0 g |
| 1-Hydroxyethylidene-1,1'-disulfonic acid | 0.35 g |
| Hydrogen peroxide | 0.08 mole |

Water was added to make 1 liter and the pH was adjusted to a value as shown in Table 4, with sulfuric acid or potassium hydroxide.

TABLE 4

| Amplification Process | 1st proc. soln $NaBO_2$ (g) | pH | Proc. time (sec) | 2nd. proc. soln. $Na_2CO_3$ (g) | pH | Proc. time (sec) | pH of mixture | Maximum density D-min R | G | B | Minimum density (Dmax) R | G | B | Density fluctuation |
|---|---|---|---|---|---|---|---|---|---|---|---|---|---|---|
| 401(Inv.) | 10.0 | 6.1 | 15 | 0.0 | 11.0 | 25 | 6.2 | 2.22 | 2.13 | 1.98 | 0.03 | 0.03 | 0.05 | ±0.06 |
| 402(Inv.) | 10.0 | 6.1 | 25 | 0.0 | 11.0 | 25 | 6.2 | 2.27 | 2.15 | 2.04 | 0.04 | 0.03 | 0.05 | ±0.07 |
| 403(Inv.) | 10.0 | 6.1 | 15 | 5.0 | 11.0 | 25 | 8.3 | 2.23 | 2.11 | 1.99 | 0.03 | 0.03 | 0.05 | ±0.06 |
| 404(Inv.) | 10.0 | 6.1 | 25 | 5.0 | 11.0 | 25 | 8.3 | 2.27 | 2.14 | 2.03 | 0.04 | 0.03 | 0.05 | ±0.06 |
| 405(Inv.) | 10.0 | 6.1 | 15 | 10.0 | 11.0 | 25 | 9.2 | 2.27 | 2.16 | 2.08 | 0.04 | 0.03 | 0.05 | ±0.03 |

TABLE 4-continued

| Amplification Process | 1st proc. soln $NaBO_2$ (g) | pH | Proc. time (sec) | 2nd. proc. soln. $Na_2CO_3$ (g) | pH | Proc. time (sec) | pH of mixture | Maximum density D-min R | G | B | Minimum density (Dmax) R | G | B | Density fluctuation |
|---|---|---|---|---|---|---|---|---|---|---|---|---|---|---|
| 406(Inv.) | 10.0 | 6.1 | 25 | 10.0 | 11.0 | 25 | 9.2 | 2.27 | 2.17 | 2.09 | 0.04 | 0.03 | 0.05 | ±0.03 |
| 407(Inv.) | 10.0 | 6.1 | 15 | 20.0 | 11.0 | 25 | 9.8 | 2.27 | 2.16 | 2.08 | 0.04 | 0.03 | 0.05 | ±0.03 |
| 408(Inv.) | 10.0 | 6.1 | 25 | 20.0 | 11.0 | 25 | 9.8 | 2.28 | 2.17 | 2.11 | 0.04 | 0.03 | 0.05 | ±0.03 |
| 409(Inv.) | 2.0 | 6.1 | 15 | 10.0 | 11.0 | 25 | 10.1 | 2.27 | 2.15 | 2.09 | 0.04 | 0.03 | 0.05 | ±0.03 |
| 410(Inv.) | 2.0 | 6.1 | 25 | 10.0 | 11.0 | 25 | 10.1 | 2.28 | 2.17 | 2.10 | 0.04 | 0.03 | 0.05 | ±0.03 |
| 411(Inv.) | 2.0 | 6.1 | 15 | 20.0 | 11.0 | 25 | 10.6 | 2.27 | 2.18 | 2.12 | 0.04 | 0.02 | 0.06 | ±0.01 |
| 412(Inv.) | 2.0 | 6.1 | 25 | 20.0 | 11.0 | 25 | 10.6 | 2.28 | 2.18 | 2.12 | 0.04 | 0.02 | 0.06 | ±0.01 |
| 413(Inv.) | 2.0 | 8.7 | 15 | 10.0 | 11.0 | 25 | 10.6 | 2.27 | 2.17 | 2.11 | 0.04 | 0.02 | 0.06 | ±0.01 |
| 414(Inv.) | 2.0 | 8.7 | 25 | 10.0 | 11.0 | 25 | 10.6 | 2.28 | 2.18 | 2.12 | 0.04 | 0.02 | 0.06 | ±0.01 |
| 415(Inv.) | 2.0 | 8.7 | 15 | 20.0 | 11.0 | 25 | 10.9 | 2.26 | 2.16 | 2.11 | 0.03 | 0.02 | 0.05 | ±0.01 |
| 416(Inv.) | 2.0 | 8.7 | 25 | 20.0 | 11.0 | 25 | 10.9 | 2.28 | 2.18 | 2.12 | 0.04 | 0.02 | 0.06 | ±0.01 |
| 417(Inv.) | 0.0 | 6.1 | 15 | 10.0 | 11.0 | 25 | 10.4 | 2.26 | 2.15 | 2.08 | 0.03 | 0.02 | 0.05 | ±0.03 |
| 418(Inv.) | 0.0 | 6.1 | 25 | 10.0 | 11.0 | 25 | 10.4 | 2.27 | 2.16 | 2.10 | 0.04 | 0.02 | 0.06 | ±0.03 |
| 419(Inv.) | 0.0 | 6.1 | 15 | 20.0 | 11.0 | 25 | 10.7 | 2.27 | 2.17 | 2.11 | 0.04 | 0.02 | 0.06 | ±0.01 |
| 420(Inv.) | 0.0 | 6.1 | 25 | 20.0 | 11.0 | 25 | 10.7 | 2.28 | 2.18 | 2.12 | 0.04 | 0.02 | 0.06 | ±0.01 |

As can be seen from Table 4, when the pH of the mixture of the first processing solution with an equal volume of the second processing solution was closer to the pH of the second processing solution, less fluctuations in density as well as a higher maximum density and lower minimum density were preferably achieved. Particularly, processes 409 to 420, in which the pH of the mixture fell within the range of ±0.5 of the pH of the second processing solution, exhibited a higher maximum density even when the processing time was shortened, and displayed marked effects of the invention.

Example 5

The photographic material sample (101) of Example 1 was imagewise exposed through photographed and processed color negative film (Konica Color LV400) and processed according to the amplification development processes 101 to 420 of Examples 1 to 4, and the obtained print images were observed. As a result, print images prepared according to the method of the invention exhibited a higher maximum density, lower minimum density and less fluctuations in density among prints, leading to excellent print images.

Example 6

A photographic material sample (102) was prepared in the same manner as Sample (101) of Example 1, except that the amounts of silver halide of the 1st layer, 3rd layer and 5th layer were varied as follows.

| | | |
|---|---|---|
| 5th layer | Red-sensitive emulsion | 0.18 g/m$^2$ |
| 3rd layer | Green-sensitive emulsion | 0.15 g/m$^2$ |
| 1st layer | Blue-sensitive emulsion | 0.26 g/m$^2$ |

Photographic material samples (101, 102) were exposed to green light for 0.5 sec. and subjected to development or amplification development according to the following process (Dev.A and Amp.) and using a color developing solution (CDC-6) or a first and second processing solution (CD-6 and OX-6) followed by desilvering process.

Processed photographic material samples were subjected to sensitometry using a densitometer PDA-65 (produced by Konica Corp.) to measure reflection densities. Subsequently, using a microdensitometer PDM-5AR (produced by Konica Corp.), the step having a green light reflection density which was the closest to 0.5, was subjected to scanning-measurement in a range of 3 mm with an aperture size of 10 $\mu$m×50 $\mu$m, and the maximum difference of the reflection density was determined as a measure for evaluating graininess. The less this value, the better the graininess, indicating less granular appearance of print images.

| Step | Time | Temperature |
|---|---|---|
| Developing (Dev. A) | | |
| Color developing (CDC-6) | 45 sec. | 38 ± 0.5° C. |
| Amplification development (Amp. 2) | | |
| 1st Processing (CD-6) | 20 sec. | 36 ± 0.5° C. |
| 2nd Processing (OX-6) | 20 sec. | 36 ± 0.5° C. |
| Desilvering process | | |
| Bleach-fixing | 30 sec. | 35 ± 0.5° C. |
| Stabilizing | 60 sec. | 30–34° C. |
| Drying | 30 sec. | 60–80° C. |

| Color developing solution (CDC-6) | |
|---|---|
| Water | 800 ml |
| Triethylenediamine | 2 g |
| Potassium bromide | 0.01 g |
| Potassium chloride | 1.0 g |
| Potassium sulfite | 0.25 g |
| N-Ethyl-N-(β-methanesulfonamidoethyl) -3-methyl-4-aminoaniline sulfate | 6.0 g |
| N,N-diethylhydroxylamine | 6.8 g |
| triethanol amine | 10.0 g |
| Sodium diethylenetriaminepentaacetate | 2.0 g |
| Potassium carbonate | 30 g |
| Aqueous soluble surfactant as shown in Table 5 | |

The pH was adjusted to 10.1 with potassium hydroxide or sulfuric acid, and water was added to make the total volume 1 liter.

| First processing solution (CD-6) | |
|---|---|
| Water | 800 ml |
| Potassium bromide | 0.001 g |
| Potassium chloride | 0.35 g |
| N-Ethyl-N-(β-methanesulfonamidoethyl) -3-methyl-4-aminoaniline sulfate | 10.0 g |
| Black-and-white developing agent (A-17) | 3.0 g |
| Aqueous soluble surfactant as shown in Table 5 | |

The pH was adjusted to 8.0 with potassium hydroxide or sulfuric acid, and water was added to make the total volume 1 liter.

| Second processing Solution (OX-6) | |
|---|---|
| Water | 800 ml |
| Disodium hydrogenphosphate | 10 g |
| Potassium carbonate | 20 g |
| Sodium diethylemetriaminepentaacetate | 2.0 g |
| l-Hydroxyethylidene-1,1'-disulfonic acid | 0.35 g |
| Aqueous soluble surfactant as shown in Table 5 | |
| Hydrogen peroxide (30%) | 5.0 ml |

Water was added to make 1 liter and the pH was adjusted to 11.0 with sulfuric acid or potassium hydroxide.

TABLE 5

| Proc. No. | Phot. sample | Process | Surfactant Kind | g/l | Soln.* | Graininess | Remark |
|---|---|---|---|---|---|---|---|
| 601 | 102 | Dev. A | — | — | — | 0.18 | Comp. |
| 602 | 102 | " | IX-2 | 0.5 | CDC-6 | 0.19 | Comp. |
| 603 | 101 | Amp. 2 | — | — | — | 0.54 | Inv. |
| 604 | 101 | " | IX-2 | 0.04 | CD-6 | 0.37 | Inv. |
| 605 | 101 | " | IX-2 | 0.04 | OX-6 | 0.32 | Inv. |
| 606 | 101 | " | IX-2 | 0.5 | CD-6 | 0.31 | Inv. |
| 607 | 101 | " | IX-2 | 0.5 | OX-6 | 0.23 | Inv. |
| 608 | 101 | " | IX-2 | 1.5 | CD-6 | 0.28 | Inv. |
| 609 | 101 | " | IX-2 | 1.5 | OX-6 | 0.21 | Inv. |
| 610 | 101 | " | IX-2 | 4.1 | CD-6 | 0.25 | Inv. |
| 611 | 101 | " | IX-2 | 4.1 | OX-6 | 0.21 | Inv. |
| 612 | 10I | " | XI-3 | 0.5 | CD-6 | 0.32 | Inv. |
| 613 | 101 | " | XI-3 | 0.5 | OX-6 | 0.24 | Inv. |
| 614 | 101 | " | VIII-1 | 0.5 | CD-6 | 0.39 | Inv. |
| 615 | 101 | " | VIII-1 | 0.5 | OX-6 | 0.36 | Inv. |
| 616 | 101 | " | II-2 | 0.5 | OX-6 | 0.32 | Inv. |
| 617 | 101 | " | III-5 | 0.5 | OX-6 | 0.31 | Inv. |
| 618 | 101 | " | IV-10 | 0.5 | OX-6 | 0.29 | Inv. |
| 619 | 101 | " | V-7 | 0.5 | OX-6 | 0.32 | Inv. |
| 620 | 101 | " | VI-1 | 0.5 | OX-6 | 0.37 | Inv. |
| 621 | 101 | " | VII-1 | 0.5 | OX-6 | 0.33 | Inv. |
| 622 | 101 | " | I-20 | 0.5 | OX-6 | 0.29 | Inv. |
| 623 | 101 | " | IX-10 | 0.5 | OX-6 | 0.28 | Inv. |
| 624 | 101 | " | X-1 | 0.5 | OX-6 | 0.29 | Inv. |

*Solution to be added

From comparison of No. 601 with 602 in Table 5, it is shown that, in conventional color development without amplification development, the use of an aqueous soluble surfactant scarcely contributed to an improvement in graininess. On the contrary, as can be seen from No. 603 to 624, when the aqueous soluble surfactant was present in the processing solution, graininess was improved. It is noted that when the aqueous soluble surfactant was present in the processing solution containing the oxidizing agent (Nos. 605, 607, 609, 611, 613, 615), graininess was markedly improved. It is further noted that when the aqueous soluble surfactant was a nonionic or anionic surfactant, the improvement was marked.

Example 7

Photographic material samples (101 and 102) were exposed to green light for 0.5 sec. and subjected to conventional development or amplification development, followed by desilvering process in a manner similar to Example 6, except that the aqueous soluble surfactant used in a color developing solution (CDC-1) or processing solutions (CD-6, OX-6) was replaced by a compound represented by Formula (B), as shown in Table 6. Samples were each evaluated in the same manner as in Example 6.

TABLE 6

| Proc. No. | Phot. sample | Process | Compound (B) Kind | mol/l | Soln.* | Graininess | Remark |
|---|---|---|---|---|---|---|---|
| 701 | 102 | Dev. A | — | — | — | 0.18 | Comp. |
| 702 | 102 | " | B-7 | $1.5 \times 10^{-2}$ | CDC-6 | 0.19 | Comp. |
| 703 | 101 | Amp. 2 | — | — | — | 0.54 | Inv. |
| 704 | 101 | " | B-7 | $1.0 \times 10^{-3}$ | CD-6 | 0.37 | Inv. |
| 705 | 101 | " | B-7 | $1.0 \times 10^{-3}$ | OX-6 | 0.38 | Inv. |
| 706 | 101 | " | B-7 | $1.5 \times 10^{-2}$ | CD-6 | 0.25 | Inv. |
| 707 | 101 | " | B-7 | $1.5 \times 10^{-2}$ | OX-6 | 0.29 | Inv. |
| 708 | 101 | " | B-7 | $8.0 \times 10^{-2}$ | CD-6 | 0.23 | Inv. |
| 709 | 101 | " | B-7 | $8.0 \times 10^{-2}$ | OX-6 | 0.28 | Inv. |
| 710 | 101 | " | B-7 | $1.2 \times 10^{-1}$ | CD-6 | 0.32 | Inv. |
| 711 | 101 | " | B-7 | $1.2 \times 10^{-1}$ | OX-6 | 0.37 | Inv. |
| 712 | 101 | " | B-24 | $1.5 \times 10^{-2}$ | CD-6 | 0.24 | Inv. |
| 713 | 101 | " | B-24 | $1.5 \times 10^{-2}$ | OX-6 | 0.29 | Inv. |
| 714 | 101 | " | B-38 | $1.5 \times 10^{-2}$ | CD-6 | 0.24 | Inv. |
| 715 | 101 | " | B-38 | $1.5 \times 10^{-2}$ | OX-6 | 0.29 | Inv. |

*Solution to be added

From comparison of No. 701 with 702 in Table 6, it is shown that, in conventional color development without amplification development, the use of the compound represented by Formula (B) scarcely contributed to an improvement in graininess. On the contrary, as can be seen from No. 703 to 715, when the compound represented by Formula (B) was present in the processing solution, graininess was improved. It is noted that when the compound represented by Formula (B) was present in the processing solution containing a color developing agent (Nos. 704, 706, 708, 710, 712 and 714), graininess was markedly improved. It is further noted that when the compound represented by Formula (B) was contained in an amount of $3.0\times10^{-3}$ mol/l to $9.0\times10^{-2}$ mol/l, the improvement was marked.

Example 8

Photographic material samples (101 and 102) were exposed to green light for 0.5 sec. and subjected to conventional development or amplification development, followed by desilvering process in a manner similar to Example 6, except that the aqueous soluble surfactant used in a color developing solution (CDC-1) or processing solutions (CD-6, OX-6) was replaced by aqueous soluble couplers exemplified, as shown in Table 7. Samples were each evaluated in the same manner as in Example 6.

TABLE 7

| Proc. No. | Phot. sample | Process | Aq. soluble coupler Kind | mmol/l | Soln.* | Graininess | Remark |
|---|---|---|---|---|---|---|---|
| 801 | 102 | Dev. A | — | — | — | 0.18 | Comp. |
| 802 | 102 | do | 23 | 25 | CDC-6 | 0.24 | Comp. |
| 803 | 101 | Amp. 2 | — | — | — | 0.54 | Inv. |
| 804 | 101 | do | 23 | 4 | CD-6 | 0.36 | Inv. |
| 805 | 101 | do | 23 | 4 | OX-6 | 0.28 | Inv. |
| 806 | 101 | do | 23 | 25 | CD-6 | 0.27 | Inv. |
| 807 | 101 | do | 23 | 25 | OX-6 | 0.24 | Inv. |
| 808 | 101 | do | 23 | 80 | CD-6 | 0.26 | Inv. |

TABLE 7-continued

| Proc. No. | Phot. sample | Process | Aq. soluble coupler Kind | mmol/l | Soln.* | Graininess | Remark |
|---|---|---|---|---|---|---|---|
| 809 | 101 | do | 23 | 80 | OX-6 | 0.22 | Inv. |
| 810 | 101 | do | 23 | 115 | CD-6 | 0.29 | Inv. |
| 811 | 101 | do | 23 | 115 | OX-6 | 0.25 | Inv. |
| 812 | 101 | do | 14 | 25 | CD-6 | 0.32 | Inv. |
| 813 | 101 | do | 14 | 25 | OX-6 | 0.28 | Inv. |
| 814 | 101 | do | 51 | 25 | CD-6 | 0.31 | Inv. |
| 815 | 101 | do | 51 | 25 | OX-6 | 0.26 | Inv. |

*Solution to be added

From comparison of No. 801 with 802 in Table 7, it is shown that, in conventional color development, the use of the aqueous soluble coupler resulted in deteriorated graininess as well as lowering of the maximum density. On the contrary, as can be seen from No. 803 to 815, when the aqueous soluble coupler was present in the processing solution, graininess was improved. It is noted that when the aqueous soluble coupler is present in the processing solution containing no color developing agent (Nos. 805, 807, 809, 811, 813, 815), graininess is markedly improved. It is further noted that when the aqueous soluble coupler is contained in an amount of 5 to 100 mmol/l, the improvement was marked.

Example 9

The photographic material sample (101) prepared in Example 1 was exposed to white light through an optical wedge for 0.5 sec. and, after being allowed to stand for 5 min., was subjected to amplification development (Amp.91 and 92), followed by desilvering process. In each of the amplification process, processing solutions were supplied in either of the following (1) or (2).

(1) Processing bath:

The photographic material sample was dipped into 1-liters of a processing solution (maintained at 35.0±1.0° C.) contained in a tank with a width of 20 cm.

(2) Spray:

A processing solution was sprayed on the photographic material in an amount of 80 ml/m$^2$, under environment maintained at 35.0±1.0° C. Between processing steps, extraneous processing solution on the surface of the photographic material was removed with a silicone rubber blade.

Processed photographic material samples were subjected to sensitometry using a densitometer PDA-65 (produced by Konica Corp.) to measure reflection densities to determine the minimum density (Dmin) and the contrast (γ). The contrast was defined as a slope of a line, on a characteristic curve, connecting two points that gave densities of 0.25 and 0.75. Similarly, the photographic material was subjected to processing and sensitometry, provided that after exposure, the photographic material was allowed to stand for 1 min. For each sample was determined difference between the contrast (γ5) in the case when being allowed to stand for 5 min. after exposure, and the contrast (γ1) in the case when being allowed to stand for 1 min. after exposure, i.e. γ5 minus γ1. The closer to 0 this value, the smaller variation in the contrast, even when the time interval from exposure to amplification development was varied. Results thereof are shown in Table 8.

| Process (Solution) | Time | Solution supply |
|---|---|---|
| Amplification development (Amp. 91) | | |
| Color developing (CD-91) | 20 sec | Processing bath |
| Activating (AA-91) | 20 sec. | Spray |
| Oxidizing (OX-91) | 45 sec. | Spray |
| Amplification development (Amp. 92) | | |
| Color developing (CD-91) | 20 sec | Processing bath |
| Oxidizing (OX-91) | 20 sec. | Spray |
| Activating (AA-91) | 45 sec. | Spray |

| Color developing solution (CD-91) | |
|---|---|
| Water | 800 ml |
| Potassium bromide | 0.001 g |
| Potassium chloride | 0.35 g |
| N-Ethyl-N-(β-methanesulfonamidoethyl) -3-methyl-4-aminoaniline sulfate | 10.0 g |
| Black-and-white developing agent (A-17) | 3.0 g |

The pH was adjusted to 8.0 with potassium hydroxide or sulfuric acid, and water was added to make 1 liter.

| Oxidizing agent solution (OX-91) | |
|---|---|
| Water | 800 ml |
| Hydrogen peroxide | 0.10 mol |

The pH was adjusted to 6.5 with potassium hydroxide or sulfuric acid, and water was added to make 1 liter.

| Activator solution (AA-1) containing amplification activator | |
|---|---|
| Water | 800 ml |
| Potassium carbonate | 25 g |

The pH was adjusted to 11.6 with potassium hydroxide or sulfuric acid, and water was added to make 1 liter.

TABLE 8

| Proc. No. | Process | γ5 . γ1 Y | M | C | Remark |
|---|---|---|---|---|---|
| 901 | Amp. 91 | 0.12 | 0.09 | 0.07 | Inv. |
| 902 | Amp. 92 | 0.25 | 0.22 | 0.15 | Inv. |

As can be seen from Table 8, in cases where the color developing agent and amplification activator were supplied before supplying an oxidizing agent for use in the amplification development, variation in the contrast of each color image forming layer was small and difference between variation width of the contrast of color image forming layers also became small. Thus, stability of the contrast and contrast balance was improved with respect to variation of the time interval between exposure and amplification development, leading to preferred embodiments of the present invention.

What is claimed is:

1. An image forming method of a silver halide light-sensitive photographic material comprising a support having thereon photographic component layers including a color image forming layer containing a silver halide emulsion and a dye providing material, the image forming method comprising the steps of:

(i) exposing the photographic material to light (ii) developing the exposed photographic material with a first processing solution and (iii) subjecting the developed photographic material to amplification with a second processing solution, wherein said first processing solution contains a black-and-white developing agent and a color developing agent, said silver halide emulsion containing silver halide grains having a chloride content of at least 80 mol % and a pH of said first processing solution being at least 0.5 less than that of said second processing solution.

2. The image forming method of claim 1, wherein said second processing solution contains an oxidizing agent.

3. The image forming method of claim 1, wherein said black-and-white developing agent is a compound represented by the following formula (A):

formula (A)

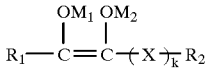

wherein $R_1$ and $R_2$ independently are an alkyl group, an amino group or an alkylthio group, provided that $R_1$ and $R_2$ may be combined with each other to form a ring; k is an integer of 0 or 1; when k is 1, X is —CO— or —CS—; and $M_1$ and $M_2$ independently are a hydrogen atom or an alkaline metal atom.

4. The image forming method of claim 1, wherein the pH of said first processing solution ($P_1$) is not less than 6.0 and less than 10.0.

5. The image forming method of claim 2, wherein difference between the pH of said first processing solution ($P_1$) and that of said second processing solution ($P_2$) is 1.0 or more.

6. The image forming method of claim 5, wherein when said first processing solution is mixed with an equal volume of said second processing solution, the pH of the mixture is closer to $P_2$ than to $P_1$.

7. The image forming method of claim 1, wherein an aqueous soluble surfactant is contained in at least one of said first and second processing solutions.

8. The image forming method of claim 1, wherein a compound represented by the following formula (B) is contained in at least one of said first and second processing solutions:

formula (B)

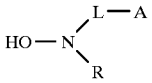

wherein L is an alkylene group which may be substituted; A is a carboxy group, sulfo group, phosphono group, phosphine group, hydroxy group, an amino group which may be substituted by an alkyl group, an ammonio group which may be substituted by an alkyl group, a carbamoyl group which may be substituted by an alkyl group, and a sulfamoyl group which may be substituted by an alkyl group; and R is a hydrogen atom or an alkyl group.

9. The image forming method of claim 1, wherein an aqueous soluble coupler capable of reacting with an oxidation product of a color developing agent is contained in at least one of said first and second processing solutions.

10. The image forming method of claim 5, wherein difference in temperature between said first and second processing solutions satisfy the following requirement:

$$T_1-T_2<10$$

wherein $T_1$ and $T_2$ are temperatures in terms of ° C. of said first and second processing solutions, respectively.

11. The image forming method of claim 1, wherein a molar ratio of the black-and-white developing agent to the color developing agent is 0.02 to 2.0.

12. The image forming method of claim 3, wherein said black-and-white developing agent is a compound represented by the following formula (A-a):

formula (A-a)

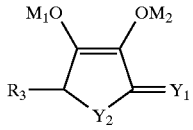

wherein $R_3$ is a hydrogen atom, an alkyl group, an aryl group, an amino group, an alkoxy group, sulfo group, carboxy group, amido group, sulfonamido group; $Y_1$ is O or S; $Y_2$ is O, S or $NR_4$, in which $R_4$ represents an alkyl group or an aryl group; and $M_1$ and $M_2$ are each the same as defined in the formula (A).

13. The image forming method of claim 4, wherein the pH of the first processing solution is not less than 7.0 and less than 9.5.

14. The image forming method of claim 7, wherein said aqueous soluble surfactant is represented by formulas (I) to (XI):

formula (I)

wherein $A_2$ represents a univalent organic group; B and C independently represents ethyleneoxy, propyleneoxy or

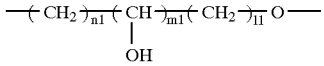

in which $n_1$, $m_1$ and $l_1$ are each an integer of 0, 1 or 2, provided that all of $n_1$, $m_1$ and $l_1$ are not 0 at the same time; m and n are each an integer of 0 to 100, provided that m and n are not 0 at the same time; and $X_1$ is a hydrogen atom, an alkyl group or an aryl group;

formula (II)

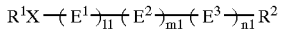

wherein $R^1$ is a hydrogen atom, an aliphatic hydrocarbon group or an acyl group; $R^2$ is a hydrogen atom or an aliphatic hydrocarbon group; $E_1$ is ethyleneoxy, $E_2$ is propyleneoxy and $E_3$ is ethyleneoxy; X is carboxy group, —O— or

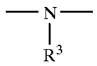

in which $R^3$ represents a hydrogen atom, an aliphatic hydrocarbon group or

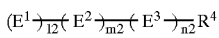

in which $R^4$ is a hydrogen atom or an aliphatic hydrocarbon group; $l_1$, $m_1$ and $n_1$ are each an integer of 0 to 100, provided that all of $l_1$, $m_1$ and $n_1$ is not 0 at the same time; and $l_2$, $m_2$ and $n_2$ are each an integer of 0 to 100, provided that all of of $l_2$, $m_2$ and $n_2$ are not 0 at the same time;

formula (III)

$$R^1\text{-}(X\text{-}L_o)_l\text{-}COOM$$

wherein $R^1$ is an aliphatic hydrocarbon group; X represents $$-CON(R^2)- \quad , \quad -SO_2N(R^3)-$$

in which $R^2$ and $R^3$ are each a hydrogen atom or the same as defined in $R^1$; l is an integer of 0 or 1; M is a hydrogen atom, an alkaline metal, ammonium ion, or an organic ammonium ion; and $L_0$ is an alkylene group;

formula (IV)

$$R^1\text{-}(X\text{-}L_o)_l(Y)_{m'}\text{-}SO_3M$$

wherein $R^1$ is an aliphatic hydrocarbon group; X represents $$-CON(R^2)- \quad , \quad -SO_2N(R^3)- \quad , \quad -COO-$$

in which $R^2$ and $R^3$ are each a hydrogen atom or the same as defined in $R^1$; l and m' are each an integer of 0 or 1; $L_0$ is an alkylene group; Y is an oxygen atom; M is an alkaline metal;

formula (V)

$$A_2\text{-}O\text{-}(CH_2CH_2O)_n\text{-}SO_3M$$

wherein $A_2$ is a univalent organic group; M is an alkaline metal; and n is an integer of 1 to 100;

formula (VI)

$$R_5\text{-}N^+(R_4)(R_6)\text{-}A\text{-}COO^-$$

wherein $R_4$, $R_5$ and $R_6$ are each an alkyl group, and $R_4$ and $R_5$ or $R_5$ and $R_6$ may combine with each other to form a ring; A is $$-(CH(R_7))_n-$$

in which $R_7$ is a hydrogen atom or an alkyl group, n is 1,2 or 3.

formula (VII)

$$R_1\text{-}N(R_2)_m\text{-}(A\text{-}X)_n$$

wherein $R_1$ is the same as defined in $A_2$ of formula (I); $R_2$ is a hydrogen atom or an alkyl group; m and n are each an integer of 0, 1 or 2, provided that the sum of m and n is 2; A is an alkyl group or an aryl group; X represents —COOM or —$SO_3M$, in which M is a hydrogen atom or an alkaline metal;

formula (VIII)

$$R_5\text{-}N^+(R_4)(R_6)\text{-}R_7 \cdot X^-$$

wherein $R_4$, $R_5$, $R_6$ and $R_7$ are each an alkyl group or a phenyl group; $X^-$ represents an anion;

formula (IX)

$$R_6\text{-}CH(COA_1R_8)\text{-}CH(R_7)\text{-}COOR_9$$

wherein one of $R_6$ and $R_7$ is a hydrogen atom or an alkyl group, and the other one is —$SO_3M$, in which M is a hydrogen atom or a univalent cation; $A_1$ is an oxygen atom or —$NR_{10}$—, in which $R_{10}$ is a hydrogen atom or an alkyl group; $R_8$ and $R_9$ are each an alkyl group, provided that an alkyl group represented by $R_8$, $R_9$ and $R_{10}$ may be substituted by a fluorine atom;

formula (X)

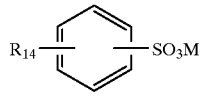

formula (X)

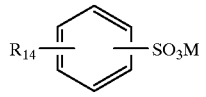

formula (XI)

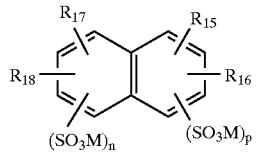

wherein $R_{14}$, $R_{15}$, $R_{16}$, $R_{17}$ and $R_{18}$ are each a hydrogen atom or an alkyl group; M is the same as defined in M of formula (III); n and p are each an integer of 0, 1, 2, 3 or 4, provided that the relation of $1 \leqq n+p \leqq 8$ is satisfied.

15. The image forming method of claim 7, wherein said aqueous soluble surfactant is contained in said second processing solution.

16. The image forming method of claim 7, wherein said said compound represented by formula (B) is contained in said first processing solution.

17. The image forming method of claim 7, wherein said aqueous soluble coupler is contained in said second processing solution.

18. The image forming method of claim 10, wherein the temperature of said second processing solution is 35° C. or higher.

* * * * *